United States Patent [19]

Maier

[11] Patent Number: 4,619,433

[45] Date of Patent: Oct. 28, 1986

[54] APPARATUS FOR ERECTING ARCUATE WALLS OF CONCRETE OR THE LIKE

[76] Inventor: Josef Maier, Schwimmbadstrasse 3, D-7611 Steinach, Fed. Rep. of Germany

[21] Appl. No.: 649,473

[22] Filed: Sep. 11, 1984

[30] Foreign Application Priority Data

Sep. 17, 1983 [DE] Fed. Rep. of Germany ..... 3333619
Apr. 19, 1984 [EP] European Pat. Off. ..... 84104458.9

[51] Int. Cl.[4] ..... B28B 7/04; B28B 7/30

[52] U.S. Cl. ..... 249/18; 249/17; 249/20; 249/48; 249/153; 249/179; 249/189; 264/32; 403/87; 403/93; 403/97

[58] Field of Search ..... 249/17, 18, 20, 33, 249/47, 48, 143, 144, 153, 179, 192, 194, 189; 52/640; 404/96; 403/84, 87, 93, 96, 97; 425/63; 264/32

[56] References Cited

U.S. PATENT DOCUMENTS 2,524,894 10/1950 Dobrin ..... 403/87
3,487,689 1/1970 Weiss et al. ..... 403/93
3,922,481 11/1975 Lewis ..... 403/97
4,361,057 11/1982 Kochera ..... 403/93
4,363,561 12/1982 Hsieh ..... 403/97

FOREIGN PATENT DOCUMENTS 2446927 4/1976 Fed. Rep. of Germany ..... 249/17

*Primary Examiner*—Jay H. Woo
*Assistant Examiner*—James C. Housel
*Attorney, Agent, or Firm*—Peter K. Kontler

[57] ABSTRACT

Apparatus for erection of arcuate walls of poured concrete has one or more deformable sheathings secured to turnable supports which are movably secured to one another by composite girders having alternating rigid variable-length links and fixed-length connectors which are affixed to the supports. The angular positions of the supports are changed by changing the length of the links. Locking devices are provided to hold the links against angular movement relative to the neighboring connectors when the sheathing assumes the desired shape. The locking devices can constitute separable components or they may be permanently mounted on and/or integrated into the links and/or connectors.

9 Claims, 19 Drawing Figures

40
107
105
21
107
3
105
108
18
L
107
4
1
2
5
29
6
9
8
9
13
11
7
14
12
8
5
9
33
14
l
11
7
33
14
8
5
R 9
33
30
32
28
27
30
31

11
7
8
14
19
16
30
15
21
18
20
33
34
29
25

12
11
10
7
14
15
22
8
18
16
19
21
17
B
5
23
20
33
29
34
13

15
19
21
20
36
35
37
43
37
41
39
38
42
7
11a
11
38
41
39
42
43
35
36
20
36
C
21
19
36

5
8
21
19
15
43
39
35
42
7
41
38
14
11a
2
11
14
38
35
43
39
5
20
8
36

APPARATUS FOR ERECTING ARCUATE WALLS OF CONCRETE OR THE LIKE

CROSS-REFERENCE TO RELATED CASE

A climbing form which can be used for erection of arcuate walls is disclosed in commonly owned copending patent application Ser. No. 536,822, now U.S. Pat. No. 4,478,385 granted Oct. 23, 1984.

BACKGROUND OF THE INVENTION

The present invention relates to apparatus for erecting arcuate walls of concrete or the like. More particularly, the invention relates to improvements in apparatus (also called slip forms) which can be used for erection of cylindrical, hemispherical or otherwise curved walls made of poured concrete or other suitable hardenable building material. Still more particularly, the invention relates to improvements in apparatus or forms of the type wherein a deformable (flexible) sheathing is secured to spaced-apart supports and its configuration can be changed by changing the angular position(s) of one or more supports.

It is already known to reinforce or stabilize an apparatus of the above outlined character by employing a composite girder including rigid (i.e., non-flexible) variable-length links which are articulately connected to each other in order to allow for a change in the configuration of the sheathing, and which also serve to hold the sheathing against deformation when the apparatus is in actual use. In many instances, the sheathing is made of wood panels but it is also known to assemble the sheathing of sheets which are made of steel or another metallic material. In many instances, especially in connection with the erection of cylindrical towers, chimneys and the like, the apparatus comprises two deformable sheaths, namely an outer sheath having a concave wall-contacting surface and an inner sheath having a convex wall contacting surface. The two sheaths are spaced apart from each other to define a space which is ready for reception of concrete or another hardenable building material. It is preferred to erect the apparatus in such a way that the space between the two sheaths is not traversed by cables, rods, anchor pins or other rigid or flexible parts which are embedded in the building material. The inserts not only weaken a concrete wall but also provide paths for the leakage of fluid which is especially undesirable if the erected structure is to constitute a water tower or another type of edifice for storage of liquids and/or other flowable materials. In such constructions, all solid inserts must be removed from the finished wall and the thus obtained holes must be sealed in a time-consuming operation. Another drawback of apparatus wherein the inner and outer sheaths are secured to each other by anchor pins or the like is that the anchor pins normally extend through the sheathings and are secured to the supports for the sheathings. This means that the supports for the outer sheathing must be properly aligned with the supports for the inner sheathing which is a time-consuming operation and contributes to the cost of the structure which is being erected.

An apparatus of the just described character is disclosed, for example, in German Pat. No. 21 40 638. In the patented apparatus, the supports for the inner sheathing (namely the sheathing which has a convex or at least partially convex surface in contact with the wall) are connected to each other by links each of which includes several straight sections. Such sections of each link are articulately connected to each other so that their mutual inclination can be changed before the thus oriented sections are fixed against further angular movement relative to each other. Pairs of neighboring supports are rigidly affixed to a section each of the adjacent links, and the mutual angular positions of such pairs of supports can be changed by means of bolts and nuts. Lock nuts are provided to fix the supports of the respective pair in selected positions.

The just described apparatus exhibits numerous additional drawbacks. The length of the links cannot be changed at will, i.e., the number of different link lengths is limited. This reduces the versatility of the patented apparatus because the apparatus cannot cause its sheathing to form a cylinder having any desired diameter. Attempts to overcome this drawback include the provision of an additional or extra section of variable length which is attached to one end of the apparatus. The extra section can be misplaced or the workmen may forget to bring it to the site of erection of a wall or the like so that the absence of the extra section can cause lengthy delays in assembly of the apparatus.

Another drawback of the patented apparatus is that the supports invariably extend at right angles to the rigid sections. Consequently, they cannot be oriented radially of the structure which is to be erected and this prevents the erection of a truly cylindrical structure. Attempts to overcome such drawback involve the utilization of auxiliary equipment which contributes to the initial and maintenance cost and prolongs the intervals which are required for erection or dismantling of the apparatus.

Still another drawback of the patented apparatus is that a change of setup takes up inordinately long intervals of time. For example, conversion of the apparatus into one that is used for the erection of larger- or smaller-diameter cylindrical towers or chimneys is very time consuming. Each such change necessitates an adjustment of the connection between each pair of supports for the sheathing and the respective rigid section of a link.

German Utility Model No. 77 04 885 discloses an apparatus which can be used as a slip form and has means for reinforcing a cylindrical sheathing. The reinforcing means employs links of infinitely variable length. Each link is a rod-like member and the end portions of neighboring links are connected to each other by pivot pins. Wedges are used to fix the neighboring links in selected angular positions relative to each other.

A drawback of the apparatus which is disclosed in the Utility Model is that it does not exhibit sufficient stability, i.e., the aforementioned wedges are not capable of standing the stresses which are likely to arise during pouring of a cylindrical wall of concrete or the like so that the mutual inclination of the links changes and the shape of the erected wall deviates from an optimum or desired shape. Moreover, the operators cannot adequately control the extent to which a wedge is driven between two neighboring links, and this also contributes to lack of stability and proneness to deformation when the apparatus is in actual use. Even if an inspection leads the person in charge to conclude that a wedge is in proper engagement with the respective links, the force with which the links are held against changes of their mutual angular positions depends solely on friction between the wedge and the links. Attempts to use wedges with roughened or toothed surfaces and/or to provide the adjacent portions of the links with roughened or toothed surfaces (i.e. to shift from a force-locking to a form-locking connection between a wedge and the neighboring links) have failed because this limits the versatility of the apparatus in that the links cannot be moved to an infinite number of angular positions. Moreover, the wedges are located at or very close to the pivot axes or bolts which connect the respective links to one another. This subjects the wedges to very pronounced deforming and other stresses. Therefore, the apparatus must employ oversized wedges or wedges consisting of extremely hard and highly expensive material. This apparatus also employs pairwise arranged supports which are parallel to each other and are connected to a common section of a variable-length link with the aforediscussed drawbacks.

OBJECTS AND SUMMARY OF THE INVENTION

An object of the invention is to provide a novel and improved apparatus for erecting arcuate walls of concrete or other building material which effectively avoids the drawbacks of conventional apparatus and offers a higher degree of stability and resistance to stresses which are likely to develop in actual use.

Another object of the invention is to provide an apparatus wherein the length of the links of the girder for the supports which carry the sheathing or sheathings can be varied infinitely in a simple and time-saving manner.

A further object of the invention is to provide an apparatus which can impart to the sheathing or sheathings a circumferentially complete shape without the need for additional or auxiliary equipment.

An additional object of the invention is to provide novel and improved means for fixing the constituents of the girder or girders in selected angular positions relative to each other.

Still another object of the invention is to provide an apparatus which is of rugged construction so that it can withstand the adverse influences of inclement weather, rain, snow, dust and/or other contaminants.

Another object of the invention is to provide a novel and improved slip form which can be converted for erection of different types of walls or the like within short periods of time.

An additional object of the invention is to provide an apparatus of the above outlined character whose versatility is higher than that of conventional apparatus.

A further object of the invention is to provide an apparatus which employs a relatively small number of different parts.

Another object of the invention is to provide the improved apparatus with a novel composite girder for the supports which carry the sheathing or sheathings.

An additional object of the invention is to provide the apparatus with novel and improved means for eliminating play between the parts which must move relative to each other when the apparatus is being converted for erection of different types of walls or the like.

A further object of the invention is to provide a novel and improved method of changing the shape and of thereupon preventing deformation of sheathings in slip forms and like apparatus.

Another object of the invention is to provide the apparatus with novel and improved means for transmitting stresses from the supports for the sheathing or sheathings to the structure which prevents deformation of the sheathing or sheathings in actual use.

An additional object of the invention is to provide an apparatus with two sheathings which is constructed and assembled in such a way that the means for adjusting the shape of one sheathing and for thereupon preventing deformation of the one sheathing in actual use of the apparatus is identical with the adjusting and deformation preventing means for the other sheathing.

Another object of the invention is to provide the above outlined apparatus with novel and improved means which can rapidly change the shape of the sheathing or sheathings and can be actuated by available tools or machines.

A further object of the invention is to provide an apparatus which can be assembled, adjusted or dismantled within shorter intervals of time than heretofore known apparatus.

The invention is embodied in an apparatus for forming an arcuate wall of concrete or the like. The apparatus comprises a plurality of spaced-apart elongated supports (such supports extend vertically if the apparatus is to be used for erection of an upright tower having a circular cylindrical, an oval or a similar outline), a flexible sheathing having spaced-apart portions which are secured to and are turnable with the supports about axes extending at least substantially longitudinally of the supports, and means for turning the supports about the corresponding axes. The turning means includes a composite girder including neighboring connectors which are turnable with the supports (each connector can be permanently or separably but preferably rigidly connected to the corresponding support), variable-length links which are disposed between pairs of neighboring connectors, fastener means for articulately connecting the links to the neighboring connectors so as to allow for changes in the angular positions of connectors and the respective supports in response to changes in the length of the links, and locking means for releasably holding the links and the respective connectors against angular movement relative to each other.

The sheathing can have a concave or a convex side facing away from the turning means, depending upon whether the sheathing is to be adjacent to the inner or to the outer side of the wall.

In accordance with one presently preferred embodiment of the invention, each link comprises a sleeve or a turnbuckle having internally threaded first and second end portions, and first and second externally threaded members (e.g., bolts) meshing with the respective end portions of the sleeve or turnbuckle. The fastener means preferably includes pivot members securing the externally threaded members to the neighboring connectors in such a way that each link is pivotable relative to the neighboring connectors (and/or vice versa) about two axes parallel to the axes about which the supports turn in response to changes in angular positions of the respective connectors. Each externally threaded member of a link can constitute a bolt having a shank which meshes with the respective end portion of the associated sleeve or turnbuckle and a head which is articulately connected to the neighboring connector by the respective pivot member. The just described links can be used in conjunction with connectors of the type having a suitably profiled (e.g., U-shaped) base, and each support can comprise a profiled portion having a shape which is complementary to that of the base of the corresponding connector. The profiled portions of the supports can be nested in the profiled bases of the corresponding connectors. Each connector can further comprise two substantially plate-like cheeks which flank the end portions of the respective links. The end portions of the links and the cheeks have registering openings (e.g., in the form of cylindrical through holes) for the corresponding pivot members which can be held against axial movement by cotter pins or the like.

It is also possible to provide each connector with a single cheek having two first detent members for complementary second detent members of two specially designed locking means. Each such locking means can comprise a carrier which is provided with a second detent member (e.g., a stud receivable in a hole or bore constituting a first detent member) cooperating with one first detent member on the respective cheek to hold the carrier against angular and/or lateral movement relative to the respective cheek. Each such locking means further comprises a pair of screws or other suitable means for releasably engaging the end portion of the respective link so that the latter is held against movement about the axis of the corresponding pivot member. Each carrier can constitute a substantially U-shaped member having a web provided with the respective second detent member and two flanges. The engaging means are provided on or in and are movable relative to the flanges into engagement with the end portion of a link which is coupled to the cheek by a pivot member. As a rule, or in many instances, each connector will comprise two spaced-apart parallel or substantially parallel cheeks which define a compartment for the heads of bolts forming part of two neighboring links. The web of each U-shaped carrier then extends across one cheek of the respective connector and the engaging means are preferably movable into engagement with parallel lateral surfaces of the head of a bolt therebetween. The one cheek of each connector can be designed in such a way that its major central portion is wider than its two end portions, and the U-shaped carrier of each locking means then extends across one end portion of the respective one cheek. The first detent members are then provided in the end portions of the one cheek.

Each locking means which has a substantially U-shaped carrier can further comprise at least one substantially U-shaped reinforcing element which is outwardly adjacent to the web and to the flanges of the corresponding carrier.

A complete apparatus will comprise a first sheathing whose convex surface faces away from the respective turning means and a second sheathing whose concave surface faces toward and is spaced apart from the convex surface of the first sheathings. Such apparatus further comprises the aforementioned turning means for the supports which carry the first sheathing, additional or second supports for the second sheathing, and a tension chord which constitutes a means for turning the second supports and includes additional variable-length links alternating with additional connectors. By changing the length of the additional links, the operators can change the angular positions of the additional connectors and of the corresponding second supports to thereby change the curvature of the second sheathing.

In a modified apparatus, each connector and/or each link can comprise two locking portions which constitute component parts of the respective locking means. In other words, the locking means can constitute or comprise permanently installed component parts of the links and/or connectors. For example, each locking portion of a connector can comprise at least one set of first tooth-shaped projections (e.g., in the form of gear segments or worm wheel segments), and each link can comprise two sets of second tooth-shaped projections (e.g., in the form of gear segments or worm wheel segments) which are comlementary to the first projections. Each set of second projections is movable into and from mesh with a set of first projections (and/or vice versa) in each of a plurality of different angular positions of the respective links relative to the neighboring connectors. If the sets of projections have arcuate shapes, their centers of curvature are preferably located on the axes of the adjacent pivot members, at least when the locking means are operative to hold the links against angular movement relative to the respective connectors and vice versa. The sets of second projections are provided on the end portions of the links and, if the end portions are bolts, they are movable, at least in part, relative to the respective central portions (such as the aforementioned sleeves) to thereby move the sets of second projections into and from mesh with the respective sets of first projections. Each locking means which includes complementary first and second sets of projections can further comprise means for arresting the end portions of the links in such positions that the sets of second projections mate with the respective sets of first projections, i.e., that the angular positions of the links relative to the neighboring connectors and vice versa remain unchanged. If each end portion of a link includes a bolt which mates with the respective central portion, the second projections can be provided on muffs which are movable axially of the respective bolts, and the arresting means then comprise lock nuts which mesh with the bolts and can hold the muffs in axial positions such that the set or sets of second projections on each muff mate with the set or sets of first projections on the adjacent connector.

Each end portion of each cheek of a connector can be provided with a set of first projections, and each muff is then formed with two sets of second projections so that it can move its projections into mesh with the adjacent sets of first projections on both cheeks of the adjacent connector. Each muff can constitute a substantially U-shaped device having a web with a hole for the respective bolt of the link and two flanges each of which is provided with a set of second projections. The projections can constitute teeth which are parallel to the axes of the pivot members. Each muff is preferably turnable on the respective end portion of the corresponding link through 180° so that the sets of second projections on such muff can alternately move into mesh with the adjacent set of first projections on the one or the other cheek of the neighboring connector. The set of second projections on one flange of each muff is preferably offset relative to the set of projections on the other flange. This feature can be resorted to in order to enhance the versatility of the apparatus by rendering it possible to greatly increase the number of different angular positions which each of the links can assume relative to the adjacent connectors. The versatility of the apparatus can be enhanced still further by making the holes in the webs of the muffs larger than the corresponding end portions of the respective links so that the muffs are movable laterally of the end portions of the links, e.g., by one-fourth of the pitch, by one-half of the pitch or by the full pitch of projections forming part of the aforementioned sets. The outlines of the projections can constitute equilateral or isosceles triangles, or they may have a substantially trapeziform shape.

Each locking means can comprise a locking device which is movable with respect to the respective link and connector substantially transversely of the respective sheathing. Each such locking device can be movably mounted on the respective connector, and each link then preferably includes suitably configurated end portions which cooperate with the respective locking devices to hold the links and the neighboring connectors in selected angular positions with reference to each other. For example, the end faces of the end portions of the links can be moved into form-locking or force-locking engagement with the lateral surfaces of the respective locking devices. The end faces can be formed with gear teeth so that each end portion of each link constitutes a gear segment. Each locking device then comprises a toothed rack which mates with the respective gear segment and is movable relative to the connector to thereby change the angular position of the adjacent link. Each locking device can comprise two toothed racks, one for each of the links which are coupled to the respective connector. Thus, one of the racks then meshes with the gear segment at one end of a first link which is adjacent to a connector, and the other rack on such connector mates with the gear segment at one end of a second link which is coupled to the connector. The arresting means for holding the toothed rack or racks of each locking means in a selected position with reference to the corresponding connector can comprise one or more cams in the form of wedges and self-locking screws which mesh with the racks and are rotatably mounted in the connector, or the like.

The locking means is preferably further designed to eliminate lateral play between each pivot member and the corresponding link and connector. To this end, each locking means can be provided with tightening means which shifts the link and/or the connector laterally of the respective pivot member and/or vice versa so that the angular positions of the link and connector remain fixed as long as the tightening means is operative. Such tightening means can comprise threaded members, e.g., the aforementioned nuts which are used to urge the muffs of specially designed locking means into engagement with the sets of teeth on the adjacent cheek or cheeks of the neighboring connector. Alternatively, the tightening means can comprise cams, e.g., wedges each of which can be driven between a pair of neighboring toothed racks on a common connector to thereby eliminate play between the teeth of such racks and the teeth of the adjacent gear segments on the links.

The locking means on each connector can comprise a twin toothed rack which meshes with gear segments on the adjacent end portions of two links. Such twin toothed rack can be replaced with a rotary worm meshing with worm wheel segments on the adjacent end portions of the respective links. The worm can be said to constitute a rotary member having a set of circumferentially extending teeth mating with the teeth on adjacent end portions of two links.

If the heads of the end portions of each link are provided with suitable cams which extend between the cheeks of the neighboring connectors, the locking means can comprise pairs of wedges or analogous cams movable through holes in the cheeks and into engagement with the cams on the end portions of the links to thereby fix the links in selected angular positions. The wedges can also perform the function of the aforementioned tightening means if the links and the connectors have some freedom of lateral movement relative to the respective pivot members, i.e., once the wedges are driven home, they eliminate any and all play between the links and connectors on the one hand and the respective pivot members on the other hand. The extent to which the wedges which constitute or form part of such locking and tightening means are driven into the holes of the respective cheeks depends on selected mutual inclination of the corresponding links and connectors.

Each locking means can comprise two variable-length arresting rods disposed between two neighboring connectors and being actuatable to hold such connectors against angular movement relative to each other once the operators have selected the desired length of the respective link. Each of the two rods can be articulately connected to one of the corresponding connectors by one of the two pivot members on such connector and to the other connector by a separate fastener. The arrangement is preferably such that the first end portion of each rod of a pair of rods is spaced apart from the second end portion of the other rod, and vice versa. Those end portions of the rods which are not connected to pivot members are preferably nearer to the respective supports.

The locking means need not necessarily have any toothed or threaded portions. For example, the end portions of the links can be formed with smooth convex end faces and the locking means on the connectors can comprise wedges disposed between the neighboring end portions of two links and having complementary concave surfaces. The center of curvature of each convex end face and of each complementary surface on a wedge is located on the axis of the corresponding pivot member. The wedges can taper in directions which are substantially parallel to the axes of the pivot members.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary plan view of an apparatus which embodies one form of the invention and is designed for the forming of arcuate concrete walls, particularly chimneys, smokestacks or the like;

DESCRIPTION OF THE PREFERRED EMBODIMENTS

Figure 1:
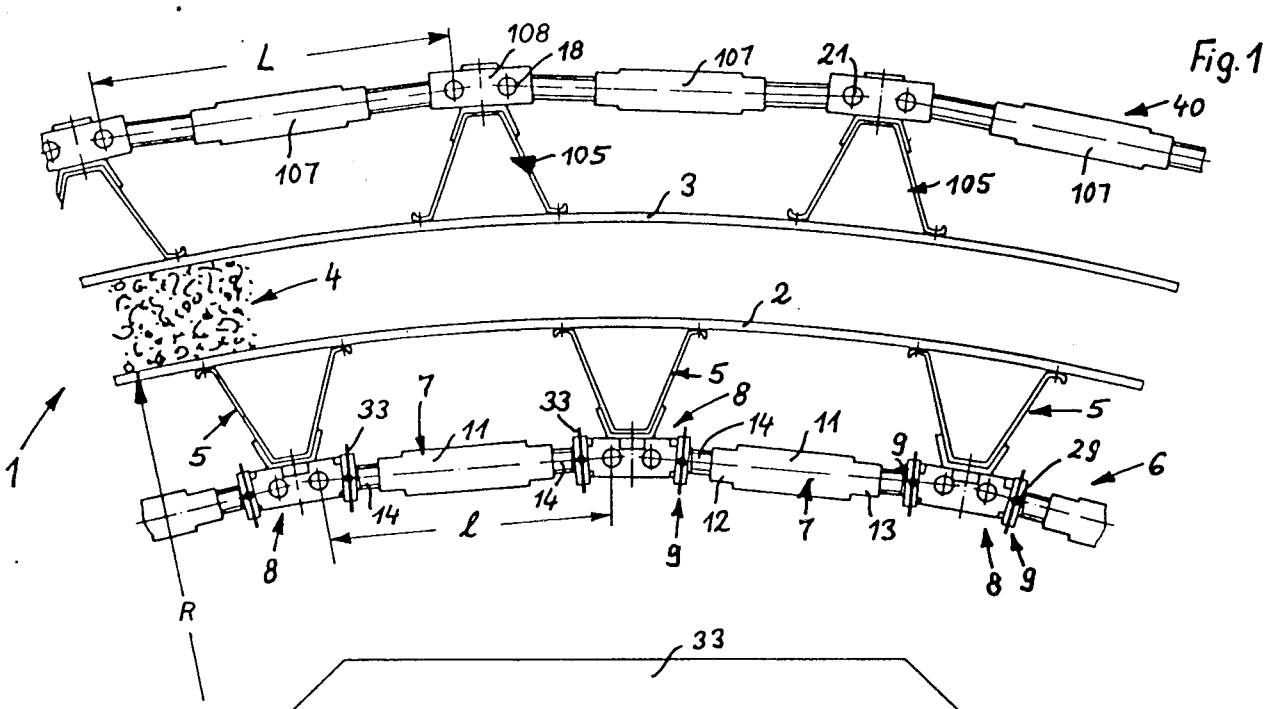

Similar parts are denoted by similar reference characters throughout the drawing. If certain parts are not specifically mentioned with reference to a particular Figure but are denoted by reference characters, such parts are to be assumed to be equivalent or identical to the described parts bearing the same reference characters.

The apparatus which is shown in FIG. 1 constitutes a form 1 for the making of a poured concrete wall a portion of which is shown at 4. The wall 4 has a concave inner side and a convex outer side and is assumed to be in the process of being formed between the two halves or sections of the improved apparatus. Such wall can form part of a tower, chimney, arcuate roof, curved balustrade or any other concrete structure which is bounded, at least in part, by convex and concave surfaces. The wall 4 may but need not taper from the bottom toward the top or vice versa.

The apparatus or form 1 comprises a flexible or deformable inner sheathing 2 which determines the outline of the concave inner side of the wall 4 and has spaced-apart portions secured to discrete elongated inner upright supports 5 by means of bolts, screws, rivets or other suitable connectors indicated by short substantially vertical lines. The outer side of the concrete wall 4 is adjacent to a second flexible or deformable sheathing 3 which has spaced-apart portions separably or permanently secured to elongated upright outer supports 105 each of which can be identical with one of the inner upright supports 5. The two sections of the apparatus 1 are set up prior to pouring of concrete which forms the wall 4 and, at such time, the curvature of the sheathings 2 and 3 must be selected with a high degree of precision in order to ensure that the thickness and the curvature of the wall 4 will meet the requirements as to accuracy and stability.

The supports 5 and 105 are turnable about vertical axes, i.e., about axes which are normal to the plane of FIG. 1, and such turnability of the supports 5 and 105 renders it possible to change the curvature of the respective sheathings 2 and 3 within a selected range.

The means for changing the angular positions of the inner upright supports 5 and hence the curvature of the corresponding inner sheathing 2 comprises a composite girder 6 connected with those portions of the support 5 which are remote from the sheathing 2. A similar girder 40, which acts as a tension chord, is provided to change the angular positions of the outer upright supports 105 and to thereby change the curvature of the outer sheathing 3. The girder 6 further serves to hold the supports 5 against changes in their angular positions during pouring of concrete into the space between the convex outer side of the sheathing 2 and the concave outer side of the sheathing 3. The tension chord 40 performs the same function as far as the turnability of the outer supports 105 is concerned.

Figure 4:
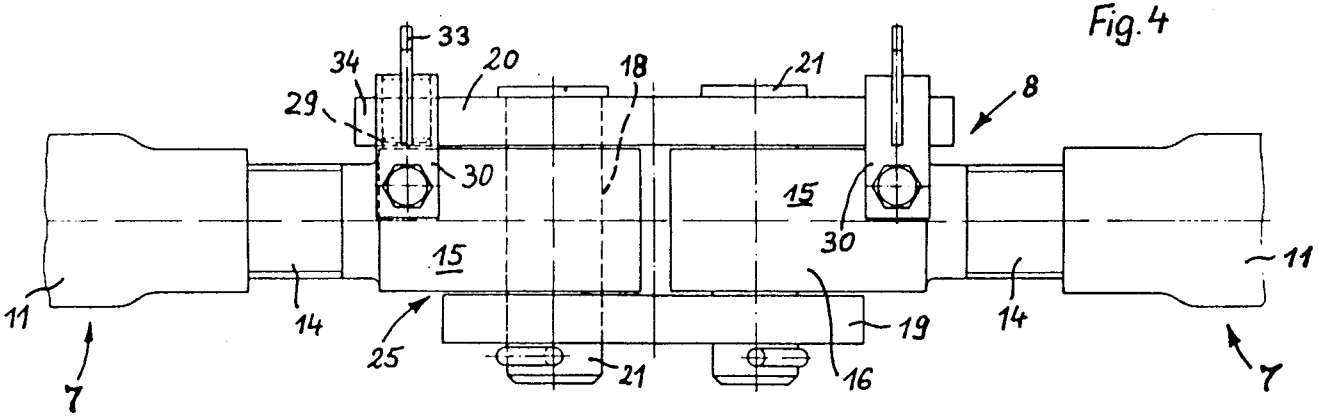
FIG. 4 is a side elevational view as seen in the direction of arrow B in FIG. 3.
Figure 3:
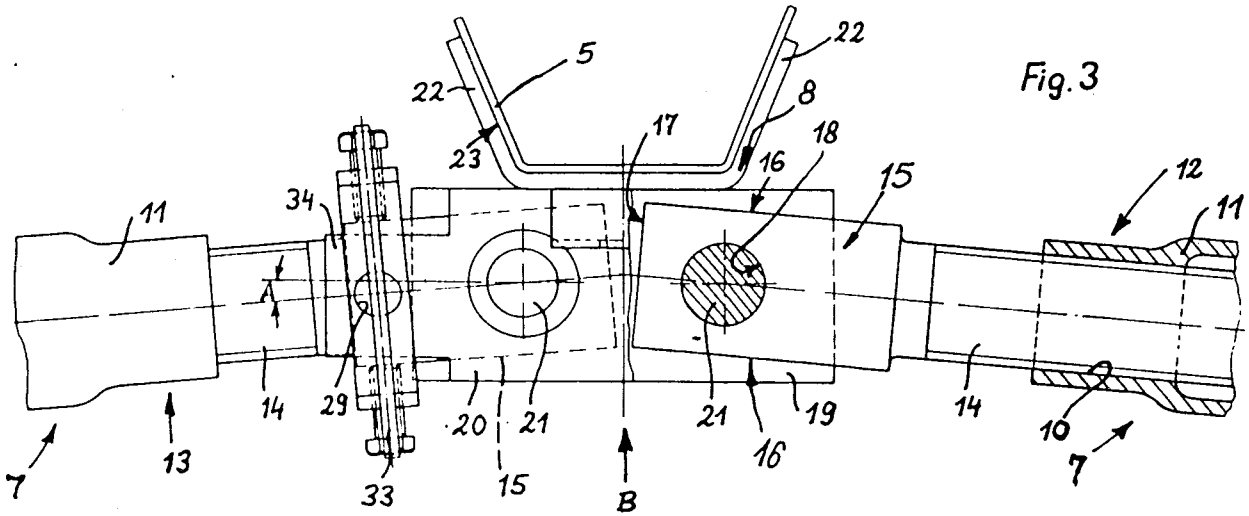
FIG. 3 is an enlarged view of a detail in the structure of FIG. 1, with certain parts shown in a horizontal sectional view.

The composite girder 6 which is shown in FIGS. 1, 3 and 4 comprises a plurality of rigid variable-length links 7 which alternate with rigid connectors 8 so that each connector is flanked by two links and each link is flanked by two connectors. Each connector 8 is permanently or separably but preferably rigidly connected to the adjacent outermost portion of the respective inner upright 5. It will be readily appreciated that, by changing the length of the links 7, the angular positions of connectors 8 and of the corresponding supports 5 will be changed to thereby change the curvature of the flexible inner sheathing 2.

The girder 6 (this girder actually constitutes a means for turning the supports 5 about the respective vertical axes) further comprises a plurality of adjustable locking means 9 which serve to arrest and hold the links 7 against angular movement relative to the neighboring connectors 8 and vice versa when the apparatus 1 is in actual use so that the curvature of the inner sheathing 2 remains unchanged until after the pouring of concrete in the space adjacent to the convex side of the sheathing 2 is completed and the concrete has set sufficiently to allow for removal of the corresponding section of the apparatus 1.

Each link 7 comprises a central portion 11 in the form of a sleeve having internally threaded end portions 12 and 13. The inner threads are shown in FIG. 3, as at 10. Each link 7 further comprises two end portions in the form of bolts 14 each having an externally threaded portion or shank meshing with the respective end portion 12 or 13 of the sleeve 11, and a head 15 which is bounded by pairs of parallel lateral surfaces 16 and a front end face 17. The length l of each link 7 can be varied by rotating the respective sleeve 11 relative to the shanks of the bolts 14. The threads 10 in the end portions 12 and 13 of each sleeve 11 are inclined in opposite directions so as to ensure rapid changes in the overall length l of a link 7 when such change in the length, with a corresponding change in the mutual inclination of the link and the neighboring connectors 8, is desired or necessary.

Each head 15 can constitute a prismatic body with neighboring lateral surfaces 16 making angles of 90° and each surface lb making an angle of 90° with the respective end face 17. Each of the surfaces 16 and the end face 17 has a rectangular outline. Each head 15 has a vertical opening 18 in the form of a through hole extending all the way between the corresponding parallel lateral surfaces 16 and serving for reception of fastener means 21 in the form of a vertical pivot member serving to articulately connect the head 15 with the neighboring connector 8. The latter comprises a substantially U-shaped base 22 which is secured to a complementary profiled portion 23 of the corresponding inner upright support 5, and two horizontal parallel plate-like cheeks 19 and 20 defining between themselves a space or compartment 25 (see FIG. 4) for reception of heads 15 of the two adjacent links 7, and more specifically of the adjacent end portions or bolts 14 of such links. The cheeks 19 and 20 have openings or holes which register with the openings 18 of the heads 15 therebetween, and each pivot member 21 extends through the registering holes of the cheeks 19, 20 as well as through the corresponding registering hole or opening 18 of the respective head 15 so that, in the absence of locking means 9, the links 7 would be free to pivot relative to the neighboring connectors 8 about vertical axes which are defined by the respective pivot members 21.

As shown in FIGS. 3 and 4, the heads 15 of the two bolts 14 which extend into the compartment or space 25 between the cheeks 19, 20 of the connector 8 which is disposed between the respective links 7 are or can be mirror symmetrical to each other with reference to a vertical plane that halves the corresponding inner upright support 5 and the connector 8. The web of the base 22 and the two cheeks 19, 20 of the connector 8 shown in FIGS. 3 and 4 together constitute a substantially U-shaped body which confines the corresponding heads 15 and carries the corresponding pair of pivot members 21 so that each of the two links 7 shown in FIGS. 3 and 4 can pivot about the axis of the corresponding pivot member 21 as long as the respective locking means 9 is loose or is removed from the connector 8. The dimensions of the heads 15 are preferably selected in such a way that the clearances between their upper sides and the underside of the cheek 20 as well as between their undersides and the upper side of the cheek 19 are minimal or negligible. Nevertheless, such clearances should be sufficient to allow for pivoting of the links 7 relative to the connector 8 which is located between them when such pivotal movements are not prevented or overly obstructed by the respective locking means 9.

Figure 2:
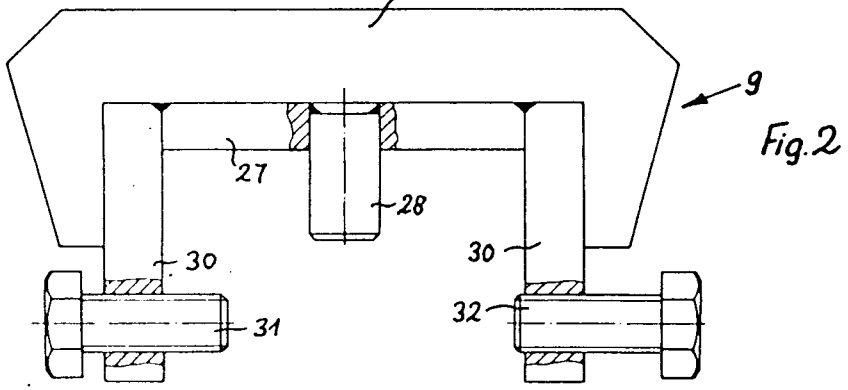
FIG. 2 is a greatly enlarged partly side elevational and partly sectional view of one of the locking means which can be utilized in the apparatus of FIG. 1.

The details of one of the locking devices 9 are illustrated in FIG. 2. This locking device comprises a substantially U-shaped member or carrier having a horizontal web 27 extending transversely of the respective end portion 34 of the cheek 20 and two vertically downwardly extending flanges 30 which are welded or otherwise secured to the respective end portions of the web 27. The U-shaped carrier including the web 27 and the two flanges 30 is surrounded by a U-shaped reinforcing element 33 so that the locking means 9 can stand pronounced deforming stresses including those which would tend to move or pivot the two flanges 30 away from each other. Those end portions of the flanges 30 which are remote from the web 27 of the carrier support two adjustable engaging means in the form of adjusting or locking screws 31, 32 which can be rotated and thereby moved axially so as to engage the adjacent lateral surfaces 16 of a head 15 between the corresponding cheeks 19 and 20. As can be seen in FIG. 2, the extent to which the threaded shank of the screw 31 extends into the space between the flanges 30 exceeds the extent of penetration of the shank of the screw 32. The extent of such penetration depends on the mutual inclination of the link 7 and connector 8 which are to be fixed or held against relative angular movement by a properly applied locking device 9. The central portion of the web 27 is provided with a downwardly or inwardly extending cylindrical stub 28 which constitutes a male detent member and is receivable in a female detent member 29 in the end portion 34 of the respective cheek 20 as shown in FIGS. 3 and 4. When the male detent member 28 is properly inserted into the female detent member 29 in the respective end portion 34 of the cheek 20, the flanges 30 of the carrier flank the adjacent head 15 between the cheeks 19, 20 and the operator can select and fix the mutual inclination of the link 7 and connector 8 by appropriate selection of the angular positions of the screws 31, 32 so that the inner end faces of such screws abut against the adjacent lateral surfaces 16 of the head 15 therebetween. This ensures that, unless the angular positions of the screws 31, 32 are changed, the angular positions of the link 7 and the connector 8 remain unchanged. It is clear that a male detent member can be provided on each end portion 34 of the cheek 20 and a female detent member can be provided in the web 27 of each carrier. As can be seen in FIG. 3 or 4, the cheek 20 has two narrower end portions 34 (only one shown in FIG. 3 wherein the right-hand part of the cheek 20 is broken away), and each connector 8 supports two locking means 9. Consequently, each end portion 34 of the cheek 20 has a female detent member 29 and the width of such end portion 34 need not appreciably deviate from the width of the respective head 15. The end portions 34 of the upper cheek 20 of each connector 8 extend longitudinally of the composite girder 6 beyond the corresponding end portions of the associated lower cheek 19.

The reference character A denotes in FIG. 3 the relatively small acute angle between the longitudinal direction of the illustrated connector 8 and the longitudinal direction of the left-hand link 7. Such angle can be increased or reduced, depending on the desired curvature of the sheathing 2. As can be seen in FIG. 1, the radius R of curvature of the outer side of the flexible inner sheathing 2 is relatively large, as compared with the length l of a link 7. Therefore, the angles A are relatively small even if the curvature of the sheathing 2 is rather pronounced. This is of advantage because it reduces the space requirements of the locking means 9. In other words, the extent to which the screws 31 and 32 of FIG. 2 must be moved axially in response to changing mutual inclination of a link 7 and the corresponding connector 8 is relatively small. Furthermore, the space requirements of the locking means 9 are negligible, and such locking means are installed in spaces which are available anyway and are out of the way so that the locking means do not interfere with the pouring of concrete and are readily accessible when the mutual inclination of the links 7 and connectors 8 must be changed. The feature that the locking means 9 comprise reinforcing elements 33 contributes to sturdiness of such locking means and to reliability of retention of links 7 and connectors 8 in selected angular positions. The male and female detent members 28, 29 cooperate to ensure that the locking means 9 cannot be shifted transversely of the respective cheeks 20 but permit angular adjustments of the locking means in order to allow for changes in mutual inclination of the corresponding connector 8 and link 7. When the screws 31 and 32 are retracted, the respective locking means 9 is automatically caused to change its angular position in response to a change of angular position of the corresponding link 7 relative to the adjacent connector 8 and/or vice versa. Once the link 7 assumes the desired angular position, the screws 31 and 32 are simply rotated until they abut against the adjacent lateral surfaces 16 of the head 15 therebetween whereby the corresponding link 7 and connector 8 are held against any angular movement relative to each other.

Another important advantage of the improved locking means 9 is that it allows for convenient and rapid secondary or fine adjustments in the mutual angular positions of the links 7 and connectors 8 after the apparatus 1 is already assembled. Thus, all that is necessary is to loosen the screws 32, 31 and to change the angular positions of the links 7 and connectors 8 prior to renewed tightening of the screws 31 and 32 so that they come into actual abutment with the adjacent lateral surfaces 16 of the head 15 which is located between such screws, i.e., between the corresponding flanges 30 of the carrier forming part of the locking means 9. The mutual inclination of links 7 and connectors 8 is changed in a very simple way by rotating the corresponding sleeves 11 so as to change the overall length l of the links. The length l is measured between the axes of the corresponding pivot members 21.

The feature that the locking means 9 are reinforced by U-shaped elements 33 contributes to the stability of such locking means and to more reliable retention of the links 7 and connectors 8 in selected angular positions. Each of the carriers including a web 27 and two flanges 30 can carry or can be confined between two or more U-shaped reinforcing elements.

As can be seen in FIGS. 3 and 4, the lower cheek 19 need not be provided with narrower end portions such as the end portions 34 of the upper cheek 20. In fact, each lower cheek 19 can be shorter than the respective upper cheek 20 so that the end portions 34 of each cheek 20 extend longitudinally of the respective connector 8 beyond the corresponding end faces of the lower cheek 19. The provision of narrower end portions 34 contributes to compactness of the locking means 9 because such locking means need not straddle the wider central portions of the respective cheeks 20.

Referring again to FIG. 1, it will be seen that the outer upright supports 105 are identical or similar to the supports 5 for the elements of the composite girder 6. The connectors 108 can constitute simplified versions of the connectors 8 because they need not be provided with means for supporting any locking means. Such locking means can be provided on or in the tension cord 40 but are optional. The links 107 are of similar design as but are longer than the links 7 of the composite girder 6. However, it is equally within the purview of the invention to use shorter links in the tension chord 40 and to replace the illustrated connectors 108 with connectors which are identical with the connectors 8 in the girder 6. This simplifies the construction of the apparatus 1 and ensures that a smaller number of different parts must be kept in storage for the purposes of repair or replacement. The manner in which the connectors 108 are secured to the links 107, namely by the provision of openings or holes 18 and fastener means in the form of pivot members 21, is preferably the same as described in connection with FIGS. 3 and 4. The length l of each link 7 can be a relatively small fraction of the length L of a link 107 forming part of the tension chord 40.

An important advantage of the improved apparatus 1 is that not only the links 7 but also the connectors 8 constitute component parts of the composite girder 6, and the connectors 108 constitute component parts of the tension chord 40. This contributes significantly to stability of the apparatus when the latter is fully assembled and is ready for the pouring of concrete or the like.

Another important advantage of the improved apparatus is that the locking means 9 allow for movement of the links 7 and neighboring connectors 8 to an infinite number of different angular positions relative to each other, i.e., the curvature of the sheathing 2 can be altered as desired and need not be round, oval or straight but can assume many much more complex shapes. The locking means 9 can be applied or dismantled with little loss in time, and their retaining or arresting action is highly reliable. It has been found that, when all of the locking means 9 are properly applied, the composite girder 6 exhibits a surprisingly pronounced stability and a highly satisfactory resistance to deformation during pouring and/or during setting of the material which is admitted into the sapce between the sheathings 2 and 3. The entire girder 6 then acts not unlike a one-piece rigid body irrespective of the selected shape of the sheathing 2.

The supports 5 and 105 can (but need not) constitute commercially available parts. If they do, the utilization of such supports contributes to lower cost of the apparatus 1 because it can use commercially available parts and/or because it can employ parts which are already available in the warehouse of the builder.

The illustrated locking means 9 exhibit the additional advantage that, when the engaging screws 31 and 32 are loose, the angular positions of the U-shaped carriers (each of which includes a web 27 and two flanges 30) automatically conform to selected angular positions of the links 7 and neighboring connectors 8 to each other so that the locking means can be rendered operative by the simple expedient of thereupon rotating the screws 31, 32 until their tips engage the adjacent lateral surfaces 16 of the heads 15 therebetween. If desired, the screws 31 and 32 can be installed in spherical sockets which are mounted in the corresponding flanges 30 to thus ensure that each of the screws 31, 32 can be moved to a practically unlimited number of positions relative to the corresponding flange 30. However, the provision of such spherical sockets for the screws 31, 32 is optional. In fact, the illustrated locking means 9 are preferred at this time because spherical sockets are likely to jam in the respective flanges when they are used in apparatus for the erection of concrete walls or the like under circumstances when the apparatus must be set up outdoors and its parts are exposed to rain, snow, dust and/or other contaminants and corrosive influences.

A further important advantage of the improved apparatus is that the locking means 9 are remote from the pivot members 21. This reduces the magnitude of forces to which the locking means are subjected when the apparatus is in use.

Figure 5:
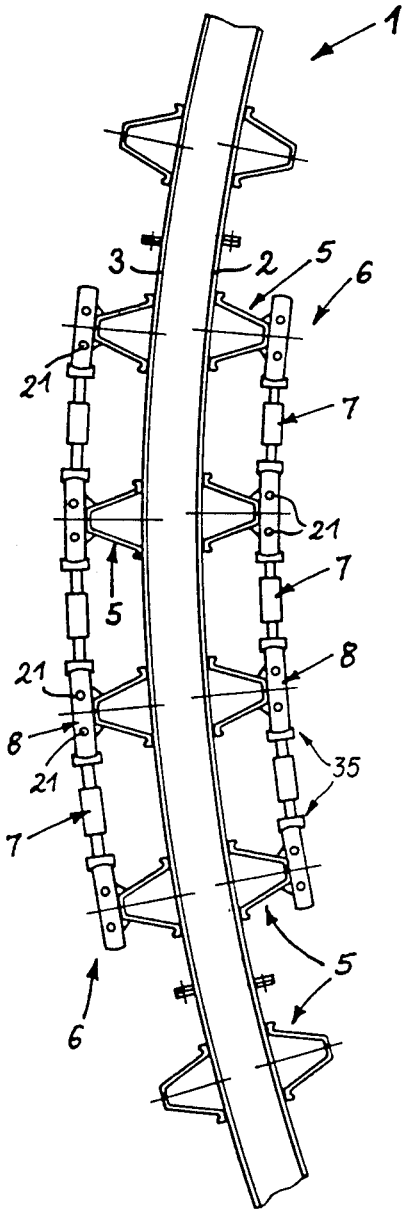
FIG. 5 is a smaller-scale view of an apparatus which constitutes a slight modification of the apparatus shown in FIGS. 1 to 4 and wherein the locking means for holding the links against angular movement relative to the adjacent connectors constitute component parts of the connectors and links.

FIG. 5 shows a modified apparatus or form 1 wherein the composite girder 6 at the concave side of the concrete wall which is formed between the sheathings 2 and 3 is preferably identical with the girder or tension chord 6 at the convex side of the concrete wall. Therefore, the component parts of each of the two girders 6 are the same or can be the same. In other words, the supports 5 at the convex side of the wall are identical with the supports 5 at the concave side and the same holds true for the links 7, connectors 8, fastener means or pivot members 21 and other constituents. The inner sheathing 2 is flexed to change its curvature in response to a shortening or lengthening of links 7 constituting component parts of the right-hand girder 6, and the curvature of the sheathing 3 is changed by altering the length of the left-hand links 7. Each connector 8 is secured to and is turnable with the respective support 5 about a substantially or exactly vertical axis in response to a change of the length of the adjacent link or links 7.

The locking means 35 for the links 7 and connectors 8 of FIG. 5 can be constructed in a manner as illustrated in FIGS. 6 to 10. A feature of such locking means is that each thereof includes a first portion which is a part of the respective connector 8 and a second portion which is a part of or is mounted on the adjacent link 7.

Figure 7:
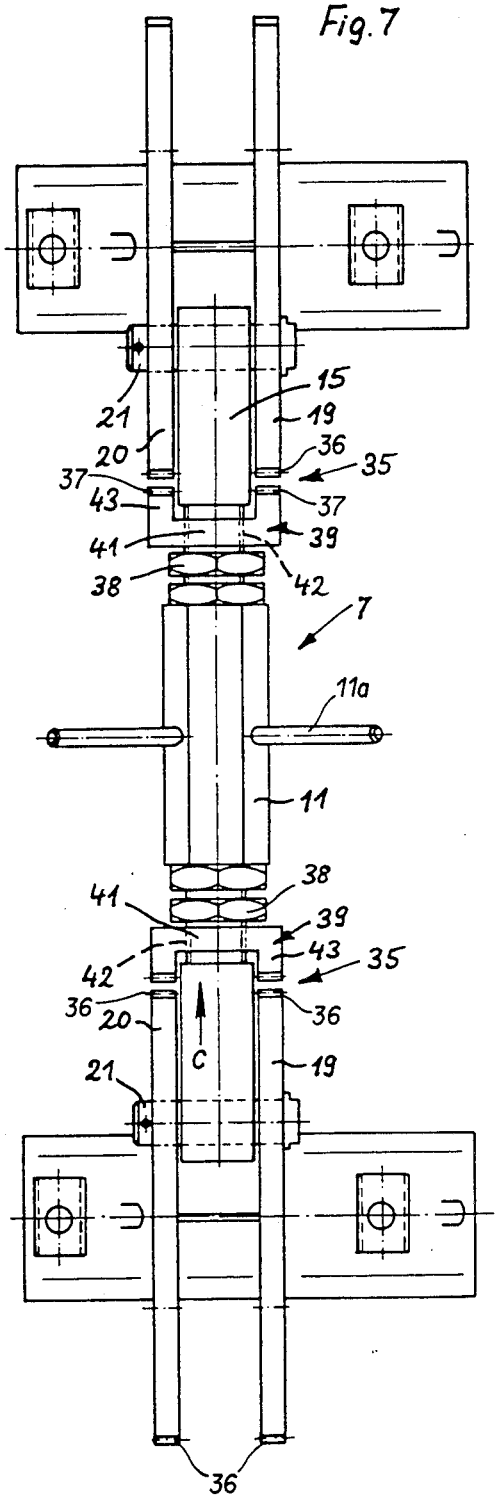
FIG. 7 is a side elevational view as seen from the right-hand side of FIG. 6.

Each of the connectors 8 shown in FIGS. 5 to 7 comprises a pair of cheeks 19, 20 each having two convex end faces which are provided with sets of tooth-shaped projections 36 (hereinafter called teeth for short). A set of teeth 36 is provided at each end of each of the two cheeks 19 and 20. Such teeth 36 constitute on each connector 8 four gear segments whose teeth have an isosceles or equilateral triangular shape. However, and as shown for example in FIG. 12, it is also possible to provide the segments on the cheeks 19 and 20 of each connector 8 with teeth 36 having substantially trapezi-form outlines. Each locking means 35 further comprises two internal ring gear segments consisting of projections in the form of teeth 37 provided on axially movable muffs 39, one on each of the bolts 14. The means for tightening the locking means 35, namely for moving the respective muffs 39 axially of the respective bolts 14 so that the teeth 37 mesh with the adjacent teeth 36 and the links 7 and the corresponding connectors 8 are thereby held in selected angular positions, includes lock nuts 38 which mesh with the shanks of the bolts 14. The center of curvature of each gear segment including a set of teeth 36 is on the axis of the corresponding pivot member 21. The same holds true for the internal ring gear segments including the teeth 37 when such teeth are in mesh with the adjacent teeth 36.

Figure 8:
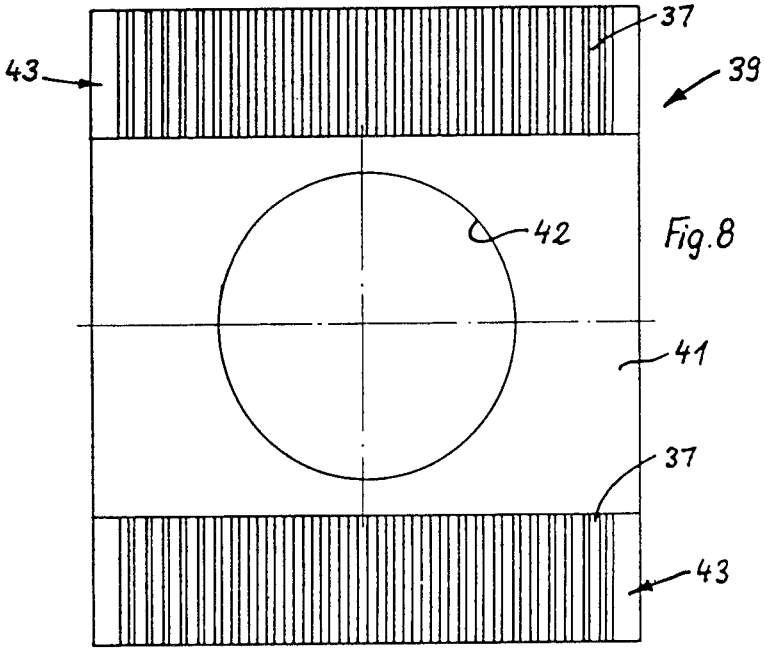
FIG. 8 is an enlarged end elevational view of a muff forming part of one of the locking means shown in FIGS. 6 and 7, the view being taken in the direction of arrow C in FIG. 7.
Figure 9:
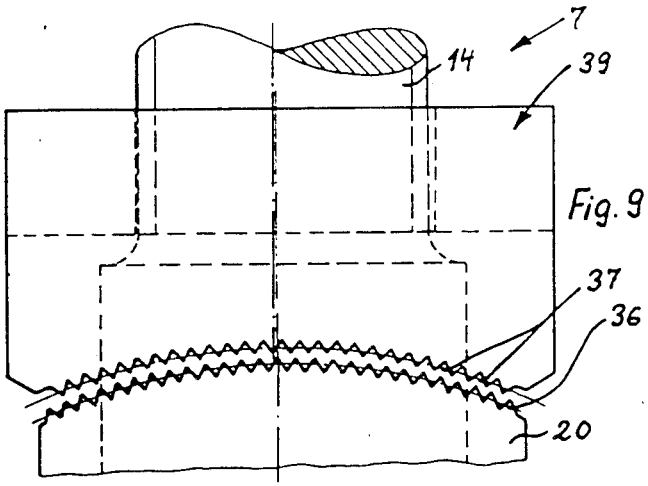
FIG. 9 is a side elevational view of the muff which is shown in FIG. 8, further showing a portion of the adjacent link and the set of tooth-shaped projections on the end portion of the adjacent cheek of the corresponding connector.

FIG. 8 shows that the muff 39 constitutes a substantially U-shaped body including a centrally located web 41 having a hole 42 for the respective bolt 14 and two flanges 43 each of which carries a set of teeth 37. This renders it possible to place one set of teeth 37 into mesh with the teeth 36 on the adjacent cheek 19 and to place the other set of teeth 37 on the same muff 39 into mesh with the teeth 36 of the adjacent cheek 20. FIG. 6 shows that the angle between the link 7 and each of the adjacent connectors 8 is a relatively small acute angle. However, the adjustability of connectors 8 relative to the link 7 and/or vice versa is preferably rather pronounced. For example and as shown in the lower part of FIG. 6 by broken lines, each connector 8 can be pivoted with the corresponding support 5 through an angle of approximately or even in excess of 90° so as to move the corresponding muff 39 between the two broken-line positions. Such angular adjustability of the connectors 8 and links 7 relative to each other is amply sufficient to ensure adequate versatility of the improved apparatus as far as the selection of curvature of concrete walls or the like is concerned.

It is equally within the purview of the invention to provide teeth 36 only on the cheek 19 or only on the cheek 20. In either event, it is desirable and advantageous to provide the muff 39 with two sets of teeth 37 because this renders it possible to change the angular position of the muff 39 through 180° by turning it around to the corresponding bolt 14 so as to place the teeth 36 of the cheek 19 or 20 into mesh with the teeth 37 on one of the flanges 43 or with the teeth 37 on the other flange 43 of the muff 39.

The space between the cheeks 19 and 20 of each connector 8 accommodates two heads 15 in the same way as described in connection with FIGS. 1 to 4. Also, the manner in which the pivot members 21 hold the heads 15 of bolts 14 in the compartments between the adjacent cheeks 19 and 20 is the same as in the embodiment of FIGS. 1 to 4.

Figure 6:
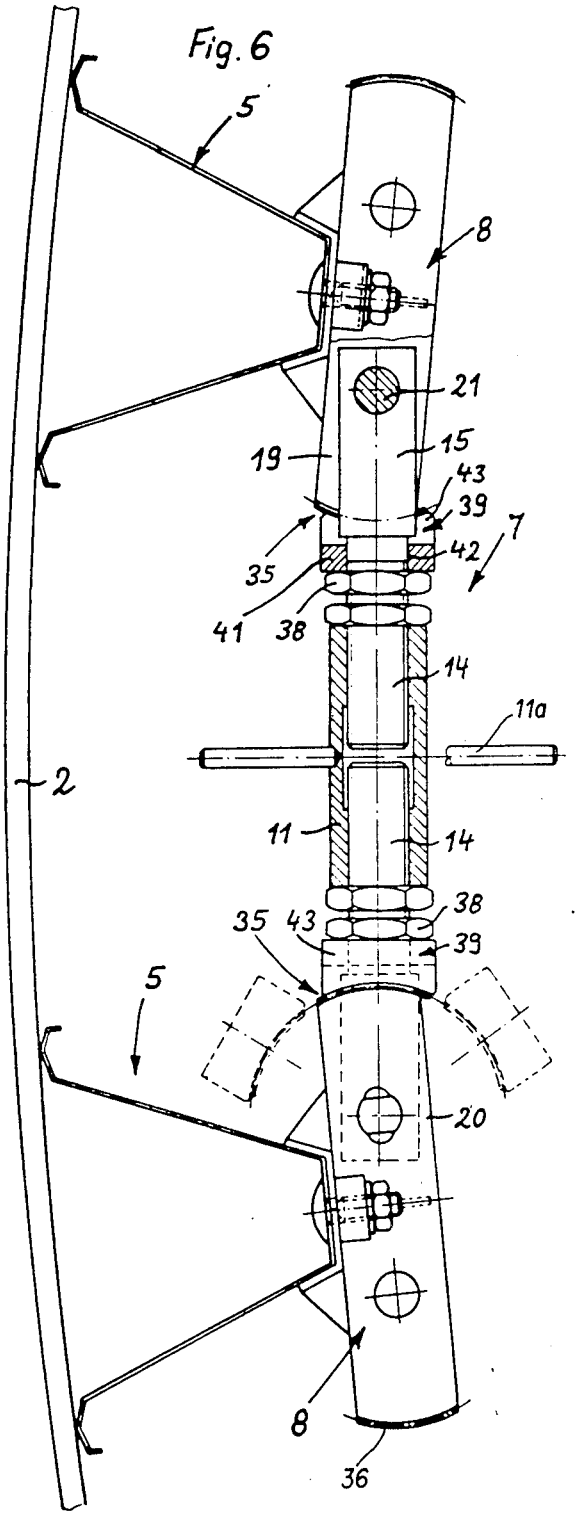
FIG. 6 is a fragmentary partly plan and partly horizontal sectional view of a portion of a modified apparatus wherein the connectors and links can be constructed in a manner as shown in FIG. 5.

FIG. 6 shows the tightening nuts 38 in their operative positions in which the muffs 39 are in engagement with the respective end portions (teeth 36) of the cheeks 19 and 20 so that the angular position of the link 7 relative to the neighboring connectors 8 and vice versa cannot be changed. On the other hand, FIG. 7 shows the nuts 38 in retracted positions (moved away from the respective heads 15) so that the muffs 39 can be shifted axially of the respective bolts 14 in order to move their sets of teeth 37 out of mesh with the teeth 36 on the adjacent end portions of the cheeks 19 and 20. The links 7 are then free to change their angular positions relative to the neighboring connectors 8 and vice versa. For example, the sleeves 11 of the links 7 can be rotated by radially outwardly extending handles **11*a* which are shown in FIGS. 6 and 7. Rotation of the sleeves 11 entails a change in the overall length of the respective links 7 and a change in the angular position of the link 7 relative to the adjacent connectors 8. Such changes in the angular positions of links 7 relative to the connectors 8 will be carried out while the muffs 39 are retracted to assume the positions shown in FIG. 7 so that the locking means 35 are inoperative. Once the angular adjustment of a link 7 relative to the neighboring connectors 8 is completed, the muffs 39 are shifted toward the adjacent cheeks 19, 20 and the tightening nuts 38 are rotated to move away from the respective ends of the sleeve 11 so as to ensure that the teeth 37 of the muff 39 remain in mesh with the teeth 36 of the cheeks 19 and 20**.

As mentioned above, the muff 39 may be mofidied in that only one of its flanges 43 is provided with teeth 37. However, it is preferred to provide each of the flanges 43 with such teeth so that either of the flanges 43 can be brought into form-locking engagement with the corresponding teeth 36 on the cheek 19 or 20 of the adjacent connector 8. As also mentioned above, the muff 39 can be rotated on the corresponding bolt 14 through 180° so as to move either of its sets of teeth 37 into mesh with the teeth 36 on the cheek 19 or 20.

In order to allow for the selection of a practically infinite number of the angular positions of the links 7 and connectors 8 relative to each other in spite of the provision of locking means 35 which comprise sets of mating teeth 36 and 37, the teeth 37 on the web 43 of a muff 39 are preferably offset with reference to the teeth 37 on the other web 43 of the same muff by one-fourth of the tooth pitch, namely by 25 percent of the distance between the top lands of two neighboring teeth 36 or 37. The plane 45 passes through the top land or tip 44 of the centrally located tooth 36 shown in FIG. 10. The distance between the planes 45 and 46 shown in FIG. 10 equals one-fourth of a pitch. Consequently, when the muff 39 is turned through 180°, the difference between the angular positions of the link 7 and connector 8 equals one-quarter of a pitch. This significantly increases the number of different angular positions which the neighboring links 7 and connectors 8 can assume relative to each other.

Figure 10:
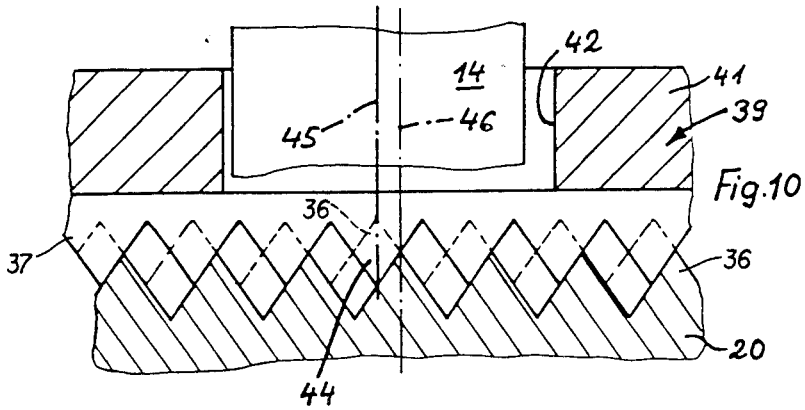
FIG. 10 is an axial sectional view of the structure which is shown in FIG. 9, a different angular position of the muff with reference to the cheek of the adjacent connector being indicated by phantom lines.

FIG. 10 further shows that the bolt 14 is received in the hole 42 of the web 41 of the muff 39 with a certain amount of lateral play. The diameter of the hole 42 exceeds the diameter of the bolt 14 by at least one-fourth of the pitch of teeth 36 or 37. This renders it possible to shift the muff 39 transversely of the bolt 14 which enables the teeth 36 and 37 to come into mesh with each other but in positions in which the teeth 36 do not extend entirely into the tooth spaces between the neighboring teeth 37 and vice versa. The difference between the diameter of the hole 42 and the diameter of the bolt 14 can equal the full pitch or half the pitch of teeth 36 or 37. All in all, such undertakings render it possible to select for each link 7 a practically infinite number of angular positions relative to the neighboring connector 8 and vice versa. This holds especially true when the difference between the diameter of the hole 42 and the diameter of the bolt 14 equals the pitch of the teeth 36 or 37.

An important advantage of the apparatus of FIGS. 6 to 10 is that it is even more likely to stand highly pronounced deforming stresses and that it ensures an even more uniform distribution of stresses in the composite girder. This is due to the fact that the locking means 35 form part of the links 7 and/or connectors 8 so that they are even more likely to eliminate unnecessary play, to prevent jackknifing of the girder and/or to prevent other undesirable deformation and/or undesirable pivoting of links 7 and connectors 8 about the axes of the respective pivot members 21 once the locking means 35 are rendered operative by moving the nuts 38 in directions away from the central portions or sleeves 11 of the respective links 7 to such an extent that the teeth 37 of the muffs 39 engage the teeth 36 of the adjacent cheeks 20 and/or 19 without any wobbling or other stray movements. The elimination or pronounced reduction of stray movements reduces the likelihood of excessive and one-sided stressing of the pivot members 21 as well as the mating teeth 36, 37. A single composite girder suffices to stabilize the corresponding section of the improved apparatus, i.e., it is not necessary to provide the apparatus with safety features in the form of additional or auxiliary girders or the like. The incorporation of locking means 35 directly into the links 7 and/or connectors 8 ensures that the stresses which are taken up by such locking means are transmitted directly to the adjacent links and/or connectors (i.e., to the corresponding supports 5 or 105). At the same time, loosening or deactivation of the locking means 35 takes up little time so that the configuration of the sheathing 2 or 3 can be changed rapidly and the stability of the girder can be restored with a minimum of delay as soon as the change in configuration of the sheathing is completed.

Each of the locking means 35 can be said to constitute a rather simple but highly effective and versatile toothed clutch. Each such clutch can transmit forces directly to the corresponding link 7 and/or connector 8 and in the longitudinal direction of the respective part to thus further reduce the likelihood of bending and/or other deformation of links and/or connectors. The teeth 36 and/or 37 need not be very deep so that one or more revolutions of the nuts 38 will suffice to move the respective muffs 39 into or from engagement with the teeth 37 of the adjacent cheek 19 and/or 20.

The provision of teeth 37 on each of the flanges 43 and the provision of teeth 36 on each of the cheeks 19, 20 is desirable and advantageous when the apparatus is designed for the erection of large structures and is expected to take up pronounced deforming, bending, jackknifing and/or other stresses.

The provision of teeth 36 on each of the flanges 43 and the staggering of such teeth in a manner as explained above in connection with FIG. 10 brings about additional advantages. Thus, locking means 35 employing such types of muffs 39 can fix the links 7 in a large number of different angular positions relative to the neighboring connectors 8 even if the teeth 36 and 37 are rather large and coarse, i.e., even if the teeth 36, 37 are designed to receive and transmit very pronounced stresses. For example, the arrangement can be such that changes in the angular positions of links 7 relative to the connectors 8 or vice versa in response to rotation of the corresponding muffs 39 through 180° can amount to half the pitch, i.e., half the distance between the tips of two neighboring teeth 36 or 37. If the just discussed feature is provided in addition to the making of a hole 42 whose diameter exceeds the diameter of the corresponding portion of the shank of the bolt 14, the locking means 35 allows for movement of the link 7 to an infinite number of angular positions relative to the corresponding connector 8. This can also be achieved without any staggering of teeth 37 on the two flanges 43 of each muff 39 if the diameter of the hole 42 exceeds the diameter of the corresponding portion of the bolt 14 by not less than half the pitch of teeth 36 or 37. The ability of links 7 to assume a practically infinite number of angular positions relative to the neighboring connectors 8 is highly desirable and advantageous, especially since it is achieved in a very simple and inexpensive way, i.e., by the mere expedient of staggering the teeth 37 on one of the flanges 43 relative to the teeth 37 on the other flange 43 of one and the same muff 39 and/or by increasing the diameter of the hole 42 beyond the diameter of the corresponding portion of the bolt 14. It is preferred, at the present time, to stagger the two sets of teeth 37 on a muff 39 in the aforedescribed manner and to provide a relatively large hole 42 whose diameter exceeds the diameter of the corresponding portion of the bolt 14 by a full pitch. The provision of teeth 36 or 37 whose outlines resemble isosceles or equilateral triangles or trapezes is desirable and advantageous because such teeth (each of which has two at least substantially mirror symmetrical halves) can be more readily introduced into the neighboring tooth spaces when the muff 39 is moved toward the teeth 36 on the adjacent end portion of the cheek 19 and/or 20.

FIGS. 11 to 16 illustrate additional embodiments of the invention wherein the locking means include portions of the links 7 as well as suitable components mounted on the respective connectors 8. The component or components which are mounted on the connectors 8 are movable substantially transversely of the inner sheathing 2 which is not specifically shown in these Figures. For example, in the apparatus which includes the structure of FIG. 12, the inner sheathing 2 is located to the left of the base 22 of the connector 8 and the components of the locking means which are mounted on such connector are two toothed racks 47 which are movable in directions to the right and to the left, as viewed in FIG. 12. The racks 47 are in form-locking engagement with the gear segments 37 at the adjacent ends of the neighboring links 7. The gear segments 37 have trapeziform teeth and the centers of curvature of such gear segments are located on the axes of the neighboring pivot members 21, namely those pivot members which connect the end portions of the links 7 to the illustrated connector 8. The axes of the pivot members 21 are parallel to the axes about which the supports for the connectors 8 turn in response to changes in angular positions of the links 7.

The means for moving the racks 47 lengthwise, namely at right angles to the axes of the pivot members 21, comprises externally threaded members in the form of self-locking spindles or screws 48 which are rotatably mounted in the connector 8 and are in mesh with the corresponding racks 47. The internal threads of the racks 47 are shown at 49. By rotating the self-locking externally threaded members 48, the operators can change the angular positions of the links 7 relative to the connector 8. The racks 47 render it possible to select a practically infinite number of different angular positions for the links 7 and connectors 8. Furthermore, angular adjustment of one of the links 7 shown in FIGS. 11 and 12 need not match the angular adjustment of the other link 7 because each of the two racks 47 is shiftable independently of the other.

Figure 11:
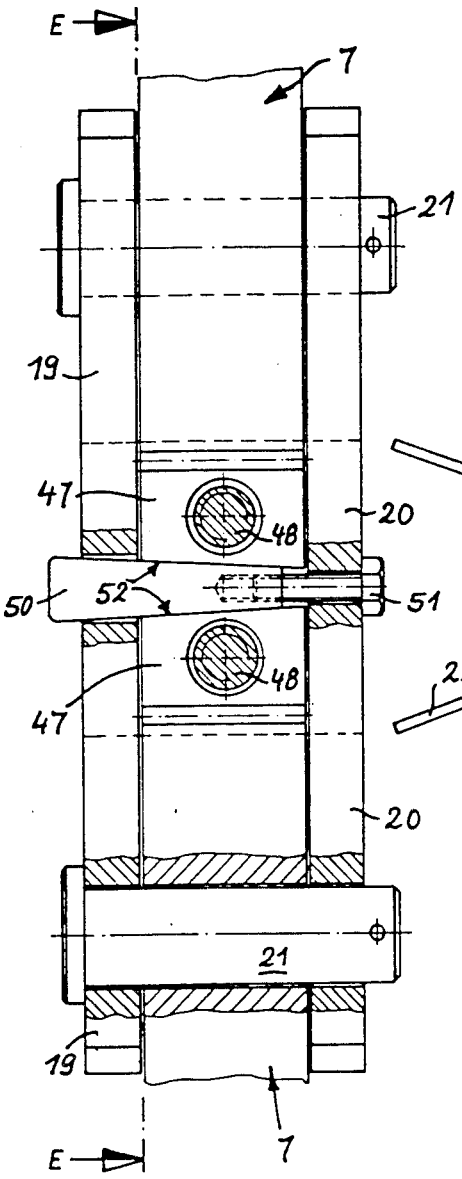
FIG. 11 is a fragmentary partly side elevational and partly sectional view of a modified apparatus wherein each locking means comprises a discrete toothed rack meshing with a set of tooth-shaped projections or gear segments on the adjacent end portion of the corresponding link, the view being taken in the direction of arrows as seen from the line D—D of FIG. 12.

The means for tightening the racks 47 in selected positions, namely for preventing any movements of the links 7 relative to the neighboring connectors 8 in selected angular positions of the links, comprises a cam in the form of a wedge 50 for each pair of racks 47. Another purpose of the wedges 50 is to eliminate any lateral play between the pivot members 21 and the corresponding links 7 and connectors 8. Thus, when the wedge 50 of FIG. 11 is pulled in a direction to the right by rotating the tightening screw 51, the cam faces 52 of the two racks 47 are engaged by the adjacent inclined faces of the wedge 50 which moves in a direction to the right, as viewed in FIG. 11, whereby the teeth of the racks 47 bear against the gear segments 37 of the adjacent links 7 and hold the links against any lateral movement relative to the corresponding pivot members 21. At the same time, the connector 8 is also held against wobbling relative to the corresponding pivot members 21 since the racks 47 and the wedge 50 are mounted thereon. As can be seen in FIG. 11, the screw 51 extends through a hole of the cheek 20 and meshes with the adjacent inner end portion of the wedge 50.

Figure 12:
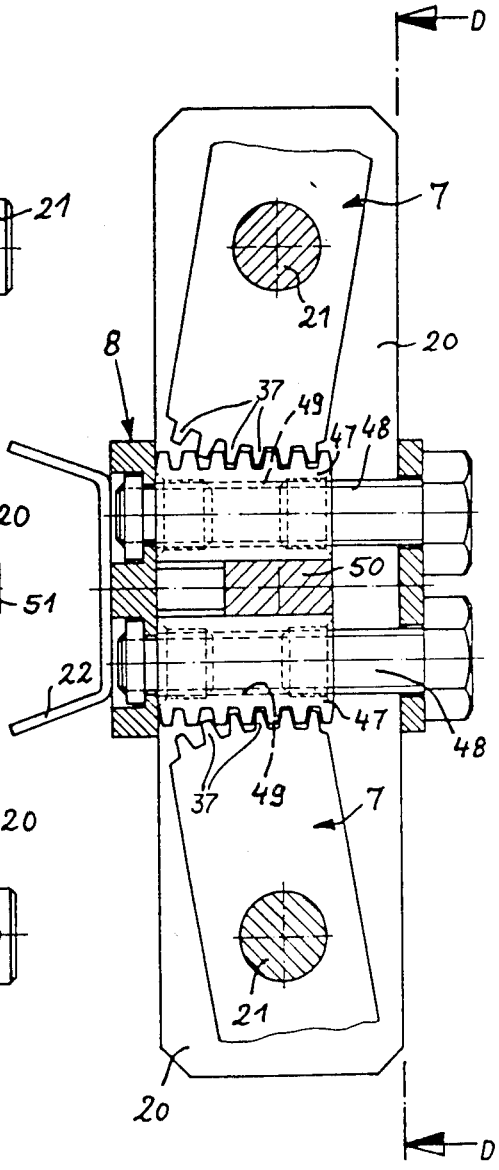
FIG. 12 is a partly plan and partly sectional view as seen in the direction of arrows from the line E—E of FIG. 11.

In a way, the wedge 50 and the screw 51 of FIGS. 11 and 12 perform the functions of nuts 38 in the embodiment of FIGS. 6 to 10. Thus, when the nuts 38 are tightened, they also prevent any play between the pivot members 21 and the corresponding links 7 and connectors 8. Such elimination of play between the pivot members 21 and the corresponding links 7 and connectors 8 is desirable and advantageous because it entails a pronounced stabilization of the entire apparatus in the course of the erection of a concrete wall or the like. An apparatus embodying such play eliminating or tightening means is much less likely to undergo deformation in response to pressures and stresses which arise during pouring of concrete. The nuts 38 and screws 51 ensure a highly desirable force-locking connection between the pivot members 21 and the adjacent links 7 and connectors 8.

Referring again to FIGS. 11 and 12, the screw 51 can also serve to expel the wedge 50 in a direction to the left, as viewed in FIG. 11, so as to release the racks 47 and to terminate the force-locking engagement between the pivot members 21 and the adjacent links 7 and connectors 8.

The locking means of the apparatus which is shown in FIGS. 11 and 12 exhibit the important advantage that the links 7 can be moved to an infinite number of angular positions relative to the neighboring connectors 8 with resort to extremely simple and inexpensive expedients. Thus, all that is necessary is to move the racks 47 axially (substantially at right angles to the respective sheathing 2 or 3) in order to change the angular position of the corresponding link 7 relative to the connector 8 or vice versa. Since the parts 48 are preferably of the self-locking type, each toothed rack 47 invariably remains in the selected position (to fix the corresponding link 7 in the selected angular position relative to the connector 8) as soon as the operator ceases to rotate the respective screw 48. This renders the provision of additional arresting means for the toothed racks 47 unnecessary and the wedges 50 serve, either exclusively or primarily, the purpose of eliminating play between the pivot members 21 on the one hand and the corresponding links 7 and connectors 8 on the other hand.

Figure 13:
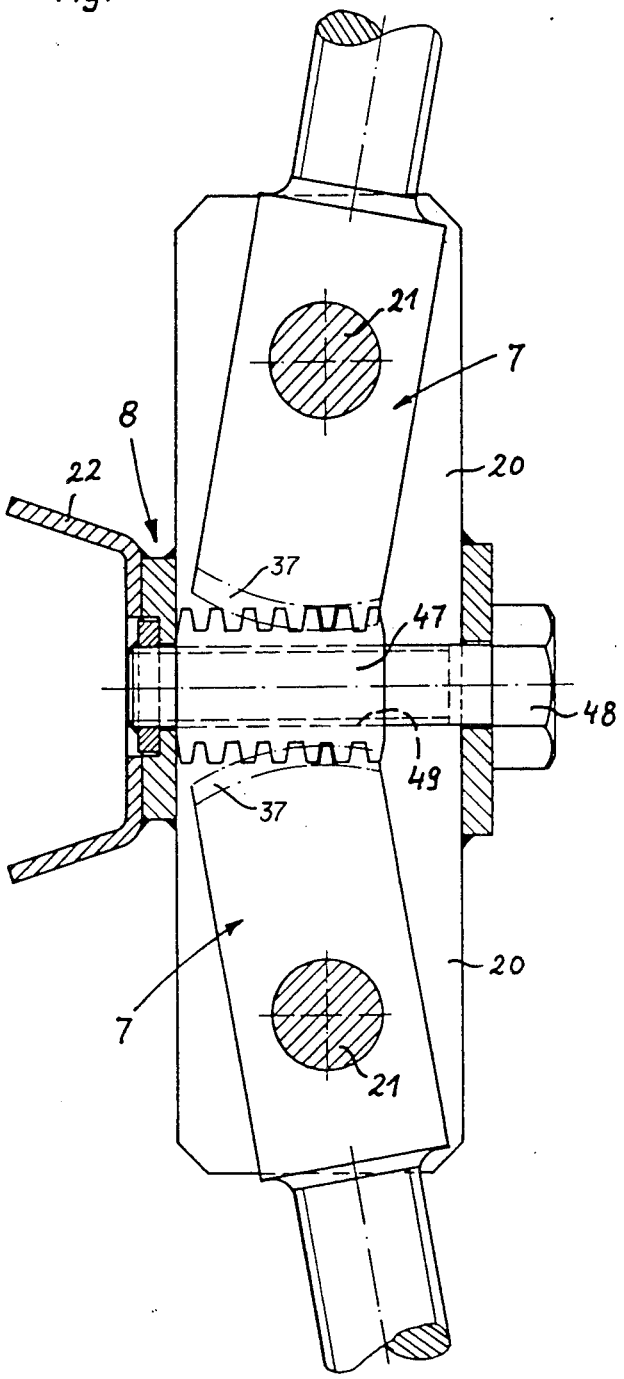
FIG. 13 is a fragmentary partly plan and partly horizontal sectional view of a modified apparatus wherein each pair of locking means on a connector comprises a twin toothed rack meshing with the gear segments on the adjacent end portions of the corresponding links.

The embodiment of FIG. 13 differentiates from the embodiment of FIGS. 11 and 12 in that the gear segments 37 at the ends of the links 7 shown in FIG. 3 are in mesh with the teeth of a twin toothed rack 47 which is reciprocable by a self-locking spindle or screw 48 mounted on the connector 8. In all other respects, the mode of operation of the locking means of FIG. 13 is identical with that of the locking means of FIGS. 11 and 12. The twin rack 47 of FIG. 13 can consist of two discrete racks which are bonded, screwed or otherwise secured to each other. The advantage of the embodiment of FIG. 13 is that the angular adjustments of the two links 7 are always identical. On the other hand, the embodiment of FIGS. 11 and 12 exhibits the advantage that each of the links 7 can be adjusted independently of the other. The embodiment of FIG. 13 is especially advantageous in connection with the pouring of concrete for domed roofs or the like. In such constructions, the pressures are normally much lower than in the pouring of concrete to form a circular tower or the like so that the means for tightening the links 7 and connectors 8 by eliminating the play between such parts on the one hand and the pivot members 21 on the other hand can be omitted. As a rule, the pouring of concrete to form a domed roof will be carried out with resort to an apparatus which comprises a single sheath having a convex surface supporting the layer of poured concrete from below. In such apparatus, simultaneous adjustments of both links 7 which are articulately connected to a connector 8 therebetween is desirable and advantageous because the curvature of the sheathing is normally constant.

Figure 14:
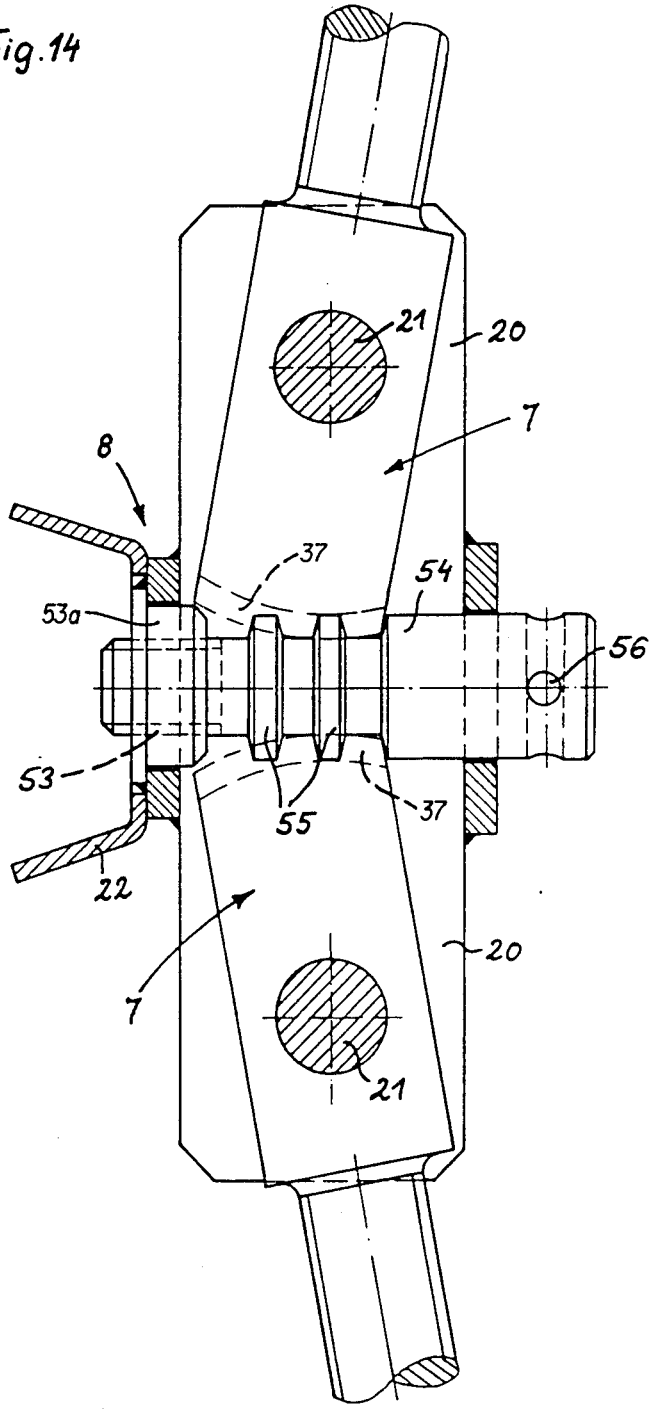
FIG. 14 is a similar partly plan and partly horizontal sectional view of an additional apparatus wherein the end portions of the links are provided with worm wheel segments meshing with an axially movable worm which is mounted on the connector.

A modification of the locking means of FIG. 13 is illustrated in FIG. 14. The end portions of the links 7 are provided with worm wheel segments 37 having centers of curvature located on the axes of the corresponding pivot members 21. The means for turning the links 7 comprises an axially movable worm 54 having a diametrically extending hole 56 for reception of a suitable tool (such as a post or pin) for rotating the worm relative to the connector 8 and for thereby changing the angular positions of the links 7. The worm 54 is preferably of the self-locking type. The reference character 55 denotes circumferentially extending teeth on the worm 54. The external thread 53 on the lefthand end portion of the worm 54 is in mesh with the internal thread of a nut 53*a* which is mounted in the connector 8. The embodiment of FIG. 14 can be utilized in apparatus which are set up for the making of domed roofs for buildings or the like. Therefore, such apparatus need not be provided with locking means having tightening or tensioning components for eliminating any and all play between the pivot members 21 on the one hand and the corresponding links 7 and connectors 8 on the other hand.

The worm 54 of FIG. 14 can be replaced with a worm having a conventional helical thread.

Figure 15:
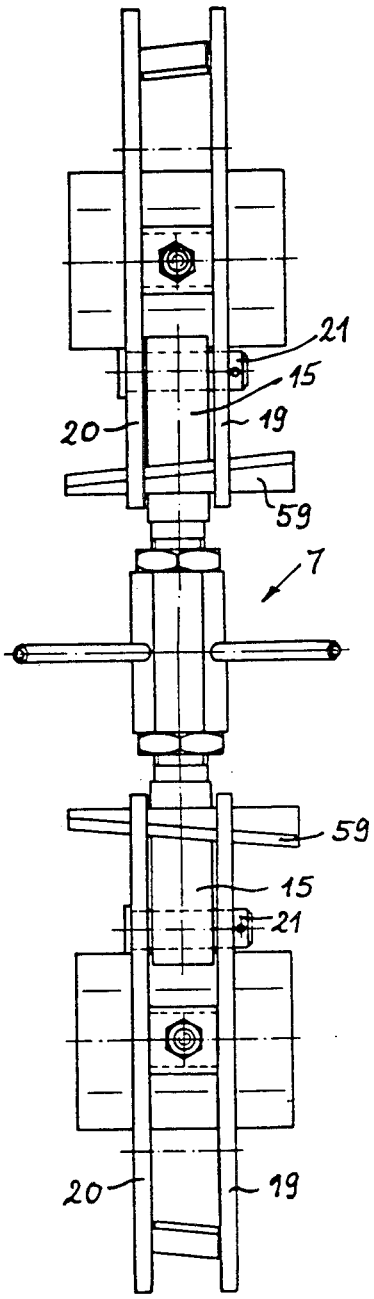
FIG. 15 is a fragmentary side elevational view of another apparatus wherein each locking means comprises several wedges which are movable into more or less pronounced engagement with cams provided on the end portions of the adjacent links.
Figure 16:
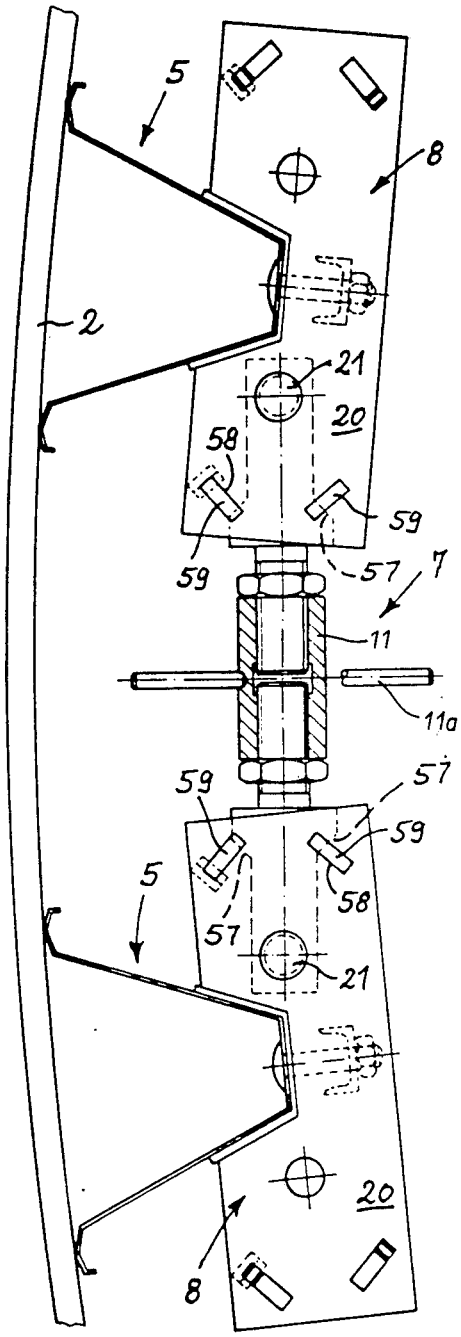
FIG. 16 is a partially plan and partially horizontal sectional view as seen from the left-hand side of FIG. 15.

Referring to the apparatus of FIGS. 15 and 16, the connectors which are shown therein have greatly enlarged cheeks 19 and 20. This is necessary and advisable because the heads 15 of the end portions of the links 7 have enlarged portions constituting cams 57 forming part of the locking means which secure the links 7 and neighboring connectors 8 against angular movement relative to each other once the angular positions of such parts are selected by appropriate rotation of the sleeves 11 through the medium of their handles 11*a*.

The cheeks 19 and 20 of each connector 8 are formed with inclined slots or apertures 58 for reception of cams in the form of tapering wedges 59 constituting component parts of the means for locking the links 7 and connectors 8 in selected angular positions. Such wedges 59 cooperate with the corresponding cams 57 on the heads 15 of the links 7. Each head 15 cooperates with two wedges 59 each of which is adjustable independently of the other so as to ensure that the angular position of each link 7 relative to the corresponding connector 8 can be changed within a desired range. Once the angular position is selected, the corresponding two wedges 59 are driven home to thereupon hold the link 7 and the connector 8 in the selected angular positions. In other words, by changing the angular positions of the links 7 relative to the adjacent connectors 8, the operators determine the extent to which the corresponding pairs of wedges 59 can be driven into the apertures 58 of the cheeks 19 and 20.

It will be noted that the wedges 59 which cooperate with the cams 57 of a head 15 are disposed in mutually inclined planes.

Figure 17:
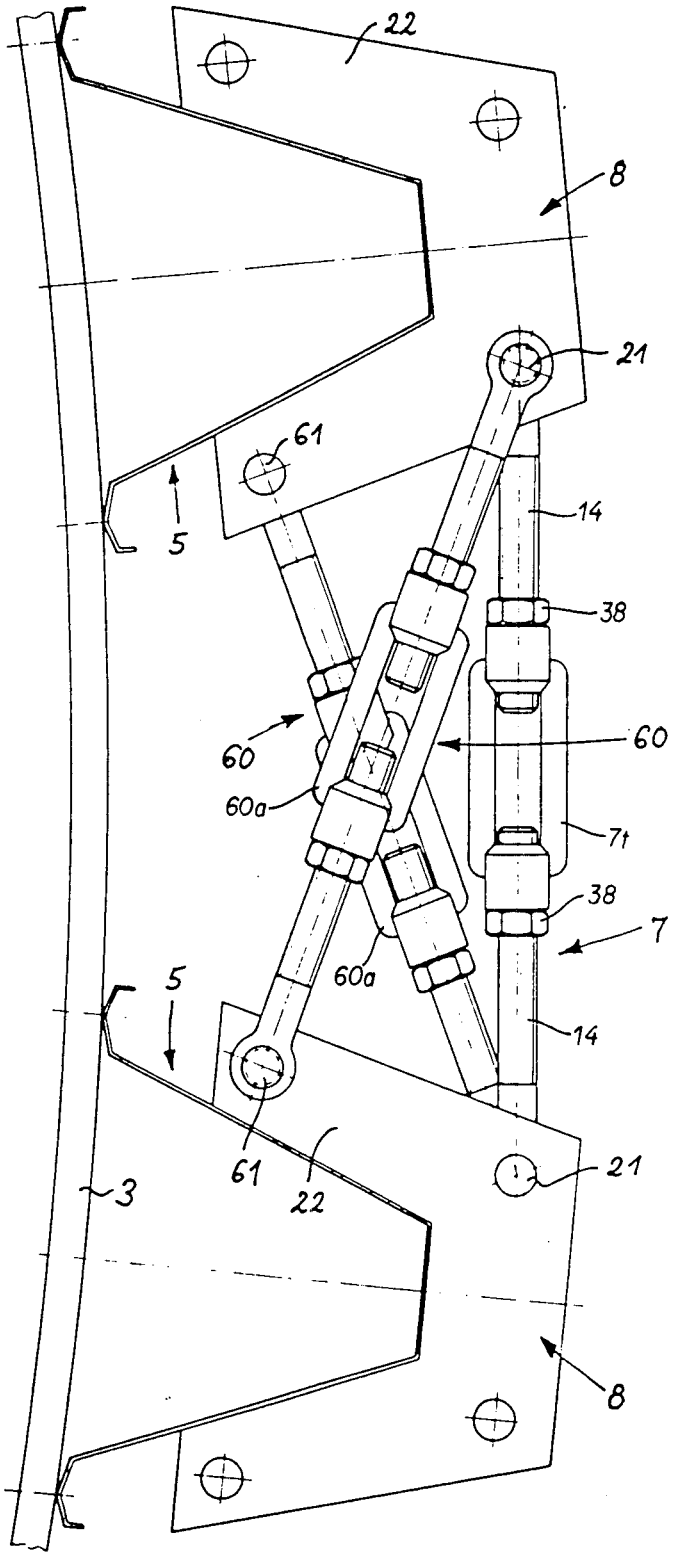
FIG. 17 is a fragmentary plan view of another apparatus wherein each link comprises a turnbuckle and each locking means comprises two variable-length rods which are mounted between two neighboring connectors.

Referring now to FIG. 17, there is shown a portion of a further apparatus wherein the variable-length link 7 between two neighboring connectors 8 has a turnbuckle 7*t* which is a functional equivalent of a sleeve 11 and can be rotated by hand or by a tool to thus change the length of the link 7. The end portions of the link 7 are articulately connected to the neighboring connectors 8 by a pair of fastener means in the form of pivot pins 21. The locking means for holding the link 7 and the connectors 8 of FIG. 7 in selected angular positions comprises two variable-length arresting rods 60. The first end portion of one arresting rod 60 is connected to the pivot member 21 for the upper end of the link 7 (as viewed in FIG. 17) and the other end of such one arresting rod is connected to a pivot member 61 which is carried by the lower connector 8 inwardly of the respective fastener means 21, i.e., closer to the sheathing 3. The other arresting rod 60 is connected to the lower fastener 21 for the link 7 and to a pivot member 61 which is located inwardly of the fastener 21 for the upper end of the link 7 and hence nearer to the sheathing 3. The bases 22 of the connectors 8 are greatly enlarged and reinforced so that they can stand stresses which are transmitted thereto by the links 7, by the two arresting rods 60, by the upright supports 5, and by the sheathing 3. The two arresting rods 60 intersect each other and their length can be varied by the respective turnbuckles 60*a*. This enables the operators to eliminate any play between the fastener means 21 and the corresponding links 7 and connectors 8. The extent to which the base 22 of each connector 8 surrounds and overlies the corresponding upright support 5 is rather pronounced. Thus, the flanges of each base 22 are longer than the distance between a pivot member 61 and the adjacent fastener means 21.

The operation of the apparatus of FIG. 17 is as follows: The angular positions of the supports 5 can be changed by changing the length of the link 7. Once the length of the link 7 is selected in response to rotation of the turnbuckle 7*t* in the appropriate direction, the locking means including the two arresting rods 60 is actuated so as to fix the illustrated connectors 8 in proper angular positions and also to eliminate any lateral play between the fastener means 21 and the corresponding end portions of the link 7 and connectors 8. It will be noted that the link 7 of FIG. 17, one of the arresting rods 60 and the corresponding connector 8 constitute a substantially triangular structure which offers pronounced resistance to undesirable changes in angular positions of the links 7 and connectors 8 relative to each other as well as to pronounced tensional and/or comptessive stresses. The same holds true for the link 7, the other arresting rod 60 and the corresponding connector base 22. The exact shape of each such triangular structure is determined by the selected length of the link 7 and/or the corresponding rod 60.

The rods 60 are preferably identical with the link 7 to thus reduce the cost of the apparatus and the number of different spare parts.

Figure 18:
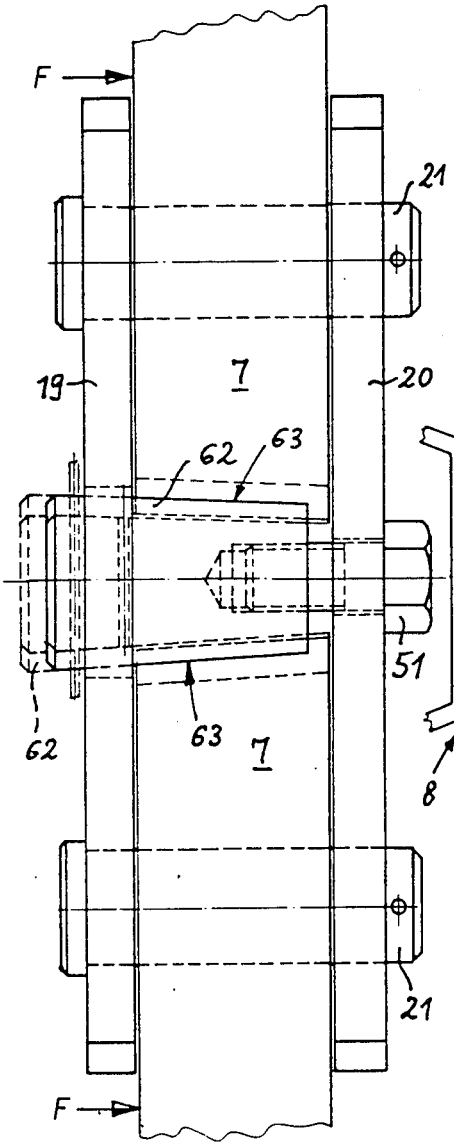
FIG. 18 is a fragmentary side elevational view of an additional apparatus wherein the end portions of the links have convex end faces cooperating with a tapering wedge forming part of the locking means.
Figure 19:
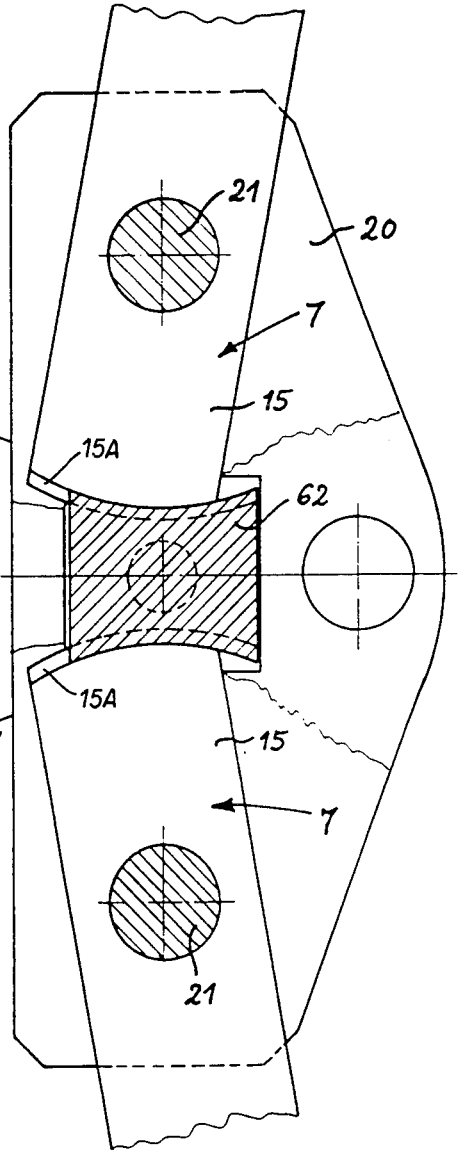
FIG. 19 is a view as seen in the direction of arrows F—F in FIG. 18.

Referring finally to FIGS. 18 and 19, there is shown a portion of an apparatus wherein the links 7 have convex end faces 15A cooperating with complementary surfaces 63 of a wedge-like locking element 62 which is movable relative to the links 7 by a tightening bolt or screw 51. The convex end faces 15A are provided on the heads 15 which form part of the end portions of the respective links 7 and are received between the cheeks 19 and 20 of the illustrated connector 8. The centers of curvature of the convex end faces 15A are located on the axes of the adjacent fastener means or pivot members 21. Such pivot members extend through registering holes or openings in the heads 15 and in the adjacent portions of the cheeks 19 and 20, the same as described in connection with FIGS. 1 to 4. Cotter pins or similar retaining devices can be provided to prevent axial shifting of properly inserted pivot members 21. The wedge 62 is movable by the bolt 51 at right angles to the axes of the pivot members 21. The surfaces 63 of the wedge 62 can be moved into pronounced frictional engagement with the adjacent convex end faces 15A to thereby hold the links 7 in selected angular positions relative to the connector 8. In principle, the operation of the locking means shown in FIGS. 18 and 19 is analogous to that of FIGS. 11 and 12.

FIG. 18 shows that the wedge 62 tapers in a direction from the cheek 19 toward the cheek 20. The inclination of the convex end faces 15A on the heads 15 of the links 7 is similar. This enables the bolt 51 to drive the surfaces 63 into a very pronounced frictional and clamping engagement with the end faces 15A to thus prevent accidental changes in the angular positions of links 7 relative to the connector 8. The illustrated surfaces 63 can be replaced with multi-facetted surfaces without departing from the spirit of the invention. However, the illustrated surfaces 63 are preferred because they can be brought into full contact with the convex end faces 15A of the adjacent links 7. The locking means of FIGS. 18 and 19 also allows for selection of an infinite number of angular positions of the links 7 relative to the connector 8 and vice versa.

The wedge 62 further serves as a means for eliminating play between the pivot member 21 on the one hand and the links 7 and connectors 8 on the other hand.

In each embodiment which comprises tightening means for eliminating play between the pivot members 21, links 7 and connectors 8, the frictional engagement between such parts as a result of elimination of play also contributes to stability of the composite girder and to the ability of the girder to take up pronounced deforming stresses.

An important advantage of the improved apparatus is that it allows for the selection of an infinite or practically infinite number of angular positions of the links 7 relative to the neighboring connectors 8 and vice versa. Moreover, the apparatus includes locking means which occupy little room and are capable of ensuring that, once properly selected, the angular positions of the links 7 and connectors 8 remain unchanged while the apparatus is in actual use, irrespective of the magnitude of stresses to which the parts of the apparatus are subjected during pouring of concrete or a similar material. In addition, the locking means can also serve as a means, or can include means, for eliminating any lateral play between the pivot members 21 and the corresponding links 7 and connectors 8 which also contributes to stability of the assembled apparatus.

Another important advantage of the improved apparatus is that it can stand very pronounced stresses in spite of the relatively large number of its components, and the ability of its components to change the curvature of the corresponding sheathing 2 or 3 within a wide range and between a practically unlimited number of different positions. The forces which develop when the improved apparatus is used for the pouring of a circular concrete wall or the like neutralize each other so that the likelihood of undesirable shifting of the apparatus, such as is observable when the stresses are applied eccentrically (as in conventional constructions) is practically nil. The apparatus of the present invention is constructed in such a way that the likelihood or possibility of jackknifing of a girder 6 and/or a chord 40 in response to stresses that develop when the apparatus is in use is eliminated in a highly efficient and reliable way. This is attributable, to a certain extent, to the fact that the locking means act against the end faces or end portions of the links 7 and thus greatly reduce the likelihood of any changes in angular position of the links 7 and connectors 8 relative to each other when such locking means are properly applied. The elimination of lateral play in the region of the pivot members 21 also contributes to stability and reliability of the improved apparatus. Such elimination of lateral play reduces the likelihood that the thickness of the wall which is being poured between the inner and outer sheathings 2 and 3 would vary as a result of unintentional and undesired changes in angular positions of the links 7 and connectors 8 relative to each other.

The improved apparatus can be assembled in such a way that the angular positions of the links 7 and connectors 8 are selected in advance before the sheathings 2 and 3 are applied to the corresponding supports 5 and/or 105. Alternatively, the sheathings 2 and 3 can be secured to the corresponding supports 5 and/or 105 before the operators begin to select the final angular positions of the links 7 and connectors 8 relative to each other. If the sheathings are applied in a final step, the apparatus can employ at least some links of fixed length. This contributes to simplicity and lower cost of the apparatus. The variable-length links are provided primarily to enhance the versatility of the apparatus so that it can be used for the erection of walls having different curvatures.

It is further clear that the improved apparatus can be used with equal advantage for the erection of straight concrete walls or the like. All that is necessary is to change the angular positions of the supports 5 and/or 105 so that the sheathings 2 and 3 are straight and are disposed in two parallel vertical planes. The apparatus is then ready for the pouring of a straight concrete wall by introducing the material into the space between the flat parallel confronting surfaces of the sheathings 2 and 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for forming an arcuate wall of concrete or the like, comprising a plurality of spaced apart elongated supports; a flexible sheathing having spaced apart portions secured to and turnable with said supports about axes extending longitudinally of said supports, said sheathing having a first side facing said supports and a second side facing away from said supports; and means for turning said supports, including a composite girder comprising neighboring connectors turnable with said supports, variable-length links disposed between neighboring connectors, fastener means for articulately connecting said links to the respective connectors so as to allow for changes in the angular positions of said connectors and the links, each of said fastener means defining a pivot axis for the respective link and the neighboring connector, and locking means for releasably holding said links and the respective connectors against angular movement relative to each other, said turning means being disposed at said one side of said sheathing, each of said connectors comprising two locking portions which constitute component parts of the respective locking means and each of said locking portions comprising a set of first tooth-shaped projections, each of said links comprising two sets of second substantialy tooth-shaped projections and each set of second projections being movable into and from mesh with a set of first projections in each of a plurality of different angular positions of the respective links relative to the neighboring connectors, said sets of projections having arcuate shapes with centers of curvature located on or close to the respective pivot axes, each of said links having a central portion and first and second end portions, said sets of second projections being provided on the end portions of the respective links and said end portions being movable, at least in part, relative to the respective central portions to thereby move said sets of second projections into and from mesh with the respective sets of first projections, each of said locking means further comprising means for arresting the end portions of said links in positions such that said sets of second projections mate with the respective sets of first projections, each of said end portions including a bolt mating with the respective central portion and a muff axially movable on the bolt and provided with the respective set of second projections, said arresting means comprising nuts meshing with the respective bolts and arranged to maintain the corresponding muffs in selected axial positions.

2. Apparatus for forming an arcuate wall of concrete or the like, comprising a plurality of spaced apart elongated supports; a flexible sheathing having spaced apart portions secured to and turnable with said supports about axes extending longitudinally of said supports, said sheathing having a first side facing said supports and a second side facing away from said supports; and means for turning said supports, including a composite girder comprising neighboring connectors turnable with said supports, variable-length links disposed between neighboring connectors, fastener means for articulately connecting said links to the respective connectors so as to allow for changes in the angular positions of said connectors and the links, each of said fastener means defining a pivot axis for the respective link and the neighboring connector, and locking means for releasably holding said links and the respective connectors against angular movement relative to each other, said turning means being disposed at said one side of said sheathing, each of said connectors comprising two locking portions which constitute component parts of the respective locking means and each of said locking portions comprising a set of first tooth-shaped projections, each of said links comprising two sets of second substantially tooth-shaped projections and each set of second projections being movable into and from mesh with a set of first projections in each of a plurality of different angular positions of the respective links relative to the neighboring connectors, said sets of projections having arcuate shapes with centers of curvature located on or close to the respective pivot axes, each of said links having a central portion and first and second end portions, said sets of second projections being provided on the end portions of the respective links and said end portions being movable, at least in part, relative to the respective central portions to thereby move said sets of second projections into and from mesh with the respective sets of first projections, each of said locking means further comprising means for arresting the end portions of said links in positions such that said sets of second projections mate with the respective sets of first projections, each of said connectors having two spaced-apart and at least substantially parallel cheeks at least one of which has two end portions each provided with a set of first projections, each end portion of each of said links further comprising a head disposed between the cheeks of the respective connector and said fastener means comprising pivot members articulately connecting said heads to the respective cheeks, each end portion of each of said links further comprising a muff provided with the respective set of second projections and movable relative to the corresponding head into and out of mesh with the set of first projections on the respective end portion of the one cheek forming part of the neighboring connector.

3. The apparatus of claim 2, wherein said muff includes a substantially U-shaped device having a web with a hole for an externally threaded part of the respective end portion of the corresponding link and two flanges at least one of which is provided with a set of second projections, said arresting means including nuts meshing with the externally threaded parts of the end portions of said links.

4. The apparatus of claim 3 wherein said projections are teeth which are parallel to the axes of said pivot members.

5. The apparatus of claim 3, wherein each of said cheeks has two sets of first projections and each flange of each U-shaped device has a set of second projections.

6. The apparatus of claim 5, wherein each of said U-shaped devices is turnable through 180° on the respective externally threaded part so that the second projections of each flange are movable into mesh with the first projections of either cheek of the respective connector.

7. The apparatus of claim 6, wherein said externally threaded parts are received in the respective holes with lateral play equal to at least one-fourth of the pitch of said sets of projections.

8. The apparatus of claim 7, wherein said play is equal to half the pitch of said sets of projections.

9. The apparatus of claim 7, wherein said play equals the pitch of said sets of projections.

* * * * *